US012781739B2

(12) United States Patent
Kim et al.

(10) Patent No.: US 12,781,739 B2
(45) Date of Patent: Nov. 3, 2026

(54) SCROLL COMPRESSOR

(71) Applicant: LG ELECTRONICS INC., Seoul (KR)

(72) Inventors: Jeonghun Kim, Seoul (KR); Changeol Jo, Seoul (KR); Nara Han, Seoul (KR); Kidae Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 145 days.

(21) Appl. No.: 18/851,941

(22) PCT Filed: Apr. 4, 2023

(86) PCT No.: PCT/KR2023/004534
§ 371 (c)(1),
(2) Date: Sep. 27, 2024

(87) PCT Pub. No.: WO2024/071543
PCT Pub. Date: Apr. 4, 2024

(65) Prior Publication Data

US 2025/0327447 A1 Oct. 23, 2025

(30) Foreign Application Priority Data

Sep. 27, 2022 (KR) ..... 10-2022-0122674

(51) Int. Cl.
*F04C 18/02* (2006.01)
*F04C 27/00* (2006.01)

(52) U.S. Cl.
CPC ..... *F04C 18/0215* (2013.01); *F04C 27/00* (2013.01); *F04C 2240/30* (2013.01)

(58) Field of Classification Search
CPC .. F04C 18/0215; F04C 2240/30; F04C 27/00; F04C 27/005; F04C 18/0253; F04C 18/0261; F04C 2240/10; F04C 2240/20; F04C 23/008; F04C 29/12
See application file for complete search history.

(56) References Cited

U.S. PATENT DOCUMENTS

2015/0192121 A1* 7/2015 Sung ..... F04C 23/008 418/55.2
2015/0345493 A1* 12/2015 Lochner ..... F04C 29/128 418/55.5
2017/0342984 A1* 11/2017 Jin ..... F04C 28/26
2022/0136501 A1* 5/2022 Yun ..... F04C 29/068 418/55.2

* cited by examiner

*Primary Examiner* — Anthony Ayala Delgado
(74) *Attorney, Agent, or Firm* — KED & ASSOCIATES

(57) ABSTRACT

Disclosed is a scroll compressor. The scroll compressor may include a retainer block inserted into a block insertion groove of a non-orbiting scroll; and a block support member that is provided between the retainer block and a back pressure chamber assembly facing same and supports the retainer block toward the non-orbiting scroll. Accordingly, a bypass valve that suppresses overcompression of a compression chamber is not fastened to a non-orbiting end plate, and thus the non-orbiting end plate may be formed thin. Also, a length of a bypass hole decreases as the non-orbiting end plate becomes thinner, thus reducing a dead volume in the bypass hole. In addition, the retainer block may be fixed tightly and securely to the block insertion groove of the non-orbiting scroll.

17 Claims, 22 Drawing Sheets

SCROLL COMPRESSOR

CROSS-REFERENCE TO RELATED PATENT APPLICATIONS

This application is a U.S. National Stage Application under 35 U.S.C. § 371 of PCT Application No. PCT/KR2023/004534, filed Apr. 4, 2023, which claims priority to Korean Patent Application No. 10-2022-0122674, filed Sep. 27, 2022, whose entire disclosures are hereby incorporated by reference.

TECHNICAL FIELD

A scroll compressor is disclosed herein.

BACKGROUND ART

A scroll compressor is configured such that an orbiting scroll and a non-orbiting scroll are engaged with each other and a pair of compression chambers is disposed between the orbiting scroll and the non-orbiting scroll while the orbiting scroll performs an orbiting motion with respect to the non-orbiting scroll.

The compression chamber includes a suction pressure chamber disposed at an outer side, an intermediate pressure chamber continuously disposed toward a central portion from the suction pressure chamber while gradually decreasing in volume, and a discharge pressure chamber connected to a center of the intermediate pressure chamber. Typically, the suction pressure chamber communicates with a refrigerant suction pipe through a side surface of a non-orbiting scroll, the intermediate pressure chamber is sealed and connected in multiple stages, and the discharge pressure chamber communicates with a refrigerant discharge pipe through a center of an end plate portion of the non-orbiting scroll.

The scroll compressor is configured so that the compression chamber continuously moves, which may cause overcompression during operation. Accordingly, in the related art scroll compressor, a bypass hole is disposed around a discharge port, that is, at an upstream side of the discharge port to discharge overcompressed refrigerant in advance. A bypass valve is disposed in the bypass hole to open and close the bypass hole according to pressure in the compression chamber. A plate valve or a reed valve is mainly applied as the bypass valve.

Patent Document 1 (US Patent Publication No. US2018/0038370 A1) discloses a scroll compressor to which a bypass valve configured as a plate valve is applied. Patent Document 1 discloses that a single bypass valve in an annular shape opens and closes a plurality of bypass holes, but this increases the number of components as the bypass valve is supported by an elastic member. In addition, since the bypass valve operates in a separated state, it is difficult to modularize the bypass valve, which may increase the number of assembling processes of the compressor. As a length of the bypass hole becomes longer, not only overcompression due to discharge delay occurs, but also a dead volume increases, which may decrease indicated efficiency.

Patent Document 2 (Korean Patent Publication No. 10-2014-0114212) and Patent Document 3 (US Patent Publication No. US2015/0345493 A1) each disclose a scroll compressor to which a bypass valve configured as a reed valve is applied. In Patent Document 2 and Patent Document 3, the bypass valve is fixed to a non-orbiting scroll using a rivet or pin. To this end, an end plate portion of the non-orbiting scroll should be as thick as a rivet depth or pin depth, which causes an increase in the length of the bypass hole. As a result, as in Patent Document 1, a refrigerant discharge through the bypass hole is delayed and thereby the refrigerant is overcompressed. In addition, a dead volume increases due to the increased length of the bypass hole, causing indicated efficiency to be degraded.

DISCLOSURE OF INVENTION

Technical Problem

Embodiments disclosed herein provide a scroll compressor that is capable of suppressing overcompression and decreasing a dead volume in a compression chamber.

Embodiments disclosed herein provide a scroll compressor that is capable of reducing a length of a bypass hole and thus decreasing a dead volume in the bypass hole.

Embodiments disclosed herein provide a scroll compressor that is capable of securing a coupling length for a bypass valve while reducing a length of a bypass hole.

Embodiments disclosed herein provide a scroll compressor capable of suppressing overcompression and decreasing a dead volume in a compression chamber while simplifying a fastening structure of a bypass valve.

Embodiments disclosed herein provide a scroll compressor in which a portion for fixing a bypass valve is configured to have a circular shape to increase machinability.

Embodiments disclosed herein provide a scroll compressor in which a portion for fixing a bypass valve is configured to have a circular shape while a sufficient opening/closing area for a plurality of bypass valves is secured.

Embodiments disclosed herein provide a scroll compressor such that a plurality of bypass valves may be easily and stably assembled.

Embodiments disclosed herein provide a scroll compressor in which a plurality of bypass valves are modularized to improve an assembling property and assembly reliability of the plurality of bypass valves.

Embodiments disclosed herein provide a scroll compressor in which a plurality of bypass valves are modularized to simply and stably assemble the plurality of bypass valves while refrigerant passing through a bypass hole may be quickly discharged.

Solution to Problem

Embodiments disclosed herein provide a scroll compressor including a casing, an orbiting scroll, and a non-orbiting scroll, a back pressure chamber assembly. The casing may have an inner space divided into a low-pressure part and a high-pressure part. The orbiting scroll may be coupled to a rotational shaft in the inner space of the casing to perform an orbiting motion. The non-orbiting scroll may be engaged with the orbiting scroll to define a compression chamber, and may be provided with a discharge port and a bypass hole through which refrigerant in the compression chamber is discharged. The back pressure chamber assembly may be included to be coupled to a rear surface of the non-orbiting scroll to press the non-orbiting scroll toward the orbiting scroll. A block insertion groove may be disposed in the rear surface of the non-orbiting scroll to be recessed by a preset depth to accommodate the discharge port and the bypass hole. A retainer block including a bypass valve configured to open or close the bypass hole may be inserted into the block insertion groove. A block support member configured to support the retainer block toward the non-orbiting scroll may be disposed between the retainer block and the back pressure chamber assembly facing the retainer block. Accordingly, the retainer block may be fixed tightly and securely into the block insertion groove in the non-orbiting scroll.

As an example, the block support member may extend from a gasket disposed outside the block insertion groove and configured to perform sealing between the rear surface of the non-orbiting scroll and a rear surface of the back pressure chamber assembly facing the rear surface of the non-orbiting scroll. Accordingly, the retainer block may be stably fixed to the non-orbiting scroll without having to include a separate fixing member, thereby reducing a manufacturing cost and simplifying a manufacture process.

For example, a gasket may be disposed between the rear surface of the non-orbiting scroll and a rear surface of the back pressure chamber assembly facing the rear surface of the non-orbiting scroll. The gasket may include: a sealing portion disposed outside the block insertion groove and between the non-orbiting scroll and the back pressure chamber assembly; and a block support portion extending from an inner circumferential surface of the sealing portion to inside of the block insertion groove to be disposed between the retainer block and the back pressure chamber assembly. Accordingly, the block support portion configured to support the retainer block may be easily disposed.

In detail, the sealing portion may be configured to have an inner diameter equal to or greater than an inner diameter of the block insertion groove. This may prevent the gasket from blocking a refrigerant discharge passage to allow refrigerant to be quickly discharged through the bypass hole.

In detail, the block support portion may be disposed in plurality, and the plurality of block support portions may be disposed on an inner circumferential surface of the sealing portion at a preset interval along a circumferential direction. By doing so, the plurality of block support portions may stably support the retainer block while being prevented from covering the refrigerant discharge passage to allow refrigerant to be quickly discharged through the bypass hole.

Here, a plurality of axial fixing protrusions extending in an axial direction may be disposed on a surface of the retainer block facing the back pressure chamber assembly at a preset interval along a circumferential direction. The plurality of block support portions may be disposed to axially correspond to the plurality of axial fixing protrusions on the retainer block. By doing so, the plurality of block support portions may stably support the retainer block in the axial direction, while the refrigerant discharge passage may be prevented from being covered by the plurality of block support portions.

Here, the plurality of block support portions may each include: an extension protrusion radially extending from the inner circumferential surface of the sealing portion; and a support protrusion axially protruding from the extension protrusion. By doing so, not only a tolerance for machining of a height of the retainer block may be increased to easily machine the non-orbiting scroll having a retainer block and/or a block insertion groove, but also the plurality of block support portions may provide elasticity in an axial direction to stably support the retainer block.

In detail, a block support surface facing the back pressure chamber assembly may be disposed on the plurality of axial fixing protrusions of the retainer block. The extension protrusion may be configured to have a sectional area smaller than or equal to a sectional area of the block support surface Accordingly, the discharge guide grooves may be prevented from being covered by the extension protrusion to allow bypassed refrigerant to move quickly toward a discharge space.

In addition, a block support surface facing the back pressure chamber assembly may be disposed on the plurality of axial fixing protrusions on the retainer block. The support protrusion may protrude toward the block support surface. Accordingly, a tolerance for the retainer block may be expanded to easily machine the retainer block while simultaneously stably securing the retainer block.

In detail, the sealing portion may include a sealing surface portion disposed between the rear surface of the non-orbiting scroll and the rear surface of the back pressure chamber assembly facing the rear surface of the non-orbiting scroll; and a sealing bead axially protruding from the sealing surface portion. The support protrusion may protrude in a direction opposite to the support protrusion. By doing so, even when the support protrusion is not configured to have an excessively great axial height, a substantially height of the supporting protrusion may be increased to tightly fix a block main body toward a block seating surface.

As another example, the block support member may be disposed to be separate from a gasket located outside the block insertion groove and configured to perform sealing between the rear surface of the non-orbiting scroll and a rear surface of the back pressure chamber assembly facing the rear surface of the non-orbiting scroll. By doing so, the gasket may be easily manufactured and assembled, while the retainer block is stably fixed.

For example, the block support member may be made of a material having elasticity to elastically support the retainer block with respect to the back pressure chamber assembly. By doing so, since an elastic member directly provides elastic force to the retainer block by being compressed between the back pressure chamber assembly and the retainer block, the retainer block may be stably supported.

In detail, a support member insertion groove may be disposed in the rear surface of the back pressure chamber assembly or one side surface of the retainer block facing the rear surface of the back pressure chamber assembly. The block support member may be inserted and fixed into the support member insertion groove. Accordingly, the block support member may be disposed separately from the gasket, while a position of the block support member may be maintained, thereby tightly fixing the retainer block.

In further detail, a plurality of axial fixing protrusions extending in an axial direction may be disposed on a surface of the retainer block facing the back pressure chamber assembly at a preset interval along a circumferential direction. The block support member may be configured to have an annular shape to terminate the plurality of axial fixing protrusions in a circumferential direction. Accordingly, the block support member may be disposed separately from the gasket, while separation of the block support member may be prevented to stably fix the retainer block.

In addition, a plurality of axial fixing protrusions extending in an axial direction may be disposed on a surface of the retainer block facing the back pressure chamber assembly at a preset interval along a circumferential direction. The block support member may be configured in an individual piece and disposed individually in each of the plurality of axial fixing protrusions. Accordingly, the block support member may be disposed separately from the gasket while the refrigerant discharge passage may be prevented from being covered by the block support member to allow bypassed refrigerant to be quickly discharged.

As still another example, an inner circumferential surface of the block insertion groove is configured to have a circular shape when projected in an axial direction. Accordingly, the retainer block and the block insertion groove into which the retainer block is inserted may be easily machined to thereby reduce a manufacture cost for the non-orbiting scroll and the retainer block.

As still another example, the retainer block may be fixedly in close contact with the rear surface of the non-orbiting scroll and a rear surface of the back pressure chamber assembly axially facing the rear surface of the non-orbiting scroll by fastening force for fastening the non-orbiting scroll and the back pressure chamber assembly. Accordingly, since the retainer block may be fixed without a separate fastening member, an assembly process for the retainer block may be simplified.

Advantageous Effects of Invention

A scroll compressor according to the present disclosure may include a block support member disposed between a retainer block inserted into a block insertion groove of a non-orbiting scroll and a back pressure chamber assembly facing the retainer block to support the retainer block toward the non-orbiting scroll. Accordingly, the retainer block may be fixed tightly and stably into the block insertion groove in the non-orbiting scroll.

A scroll compressor according to the present disclosure may be configured such that a block support member is disposed outside a block insertion groove to extend from a gasket configured to perform sealing between a rear surface of a non-orbiting scroll and a rear surface of a back pressure chamber assembly facing the rear surface of the non-orbiting scroll. Accordingly, the retainer block may be stably fixed to the non-orbiting scroll without having to include a separate fixing member, thereby reducing a manufacturing cost and simplifying a manufacture process.

A scroll compressor according to the present disclosure may be configured such that a block support member is disposed outside a block insertion groove to be separate from a gasket configured to perform sealing between a rear surface of a non-orbiting scroll and a rear surface of a back pressure chamber assembly facing the rear surface of the non-orbiting scroll. By doing so, the gasket may be easily manufactured and assembled, while the retainer block is stably fixed.

A scroll compressor according to the present disclosure may be configured such that an inner circumferential surface of a block insertion groove may have a circular shape when projected in an axial direction. Accordingly, the retainer block and the block insertion groove into which the retainer block is inserted may be easily machined to thereby reduce a manufacture cost for the non-orbiting scroll and retainer block.

A scroll compressor according to the present disclosure may be configured such that a retainer block is fixedly in close contact with a rear surface of a non-orbiting scroll and a rear surface of a back pressure chamber assembly axially facing the rear surface of the non-orbiting scroll by fastening force for fastening the non-orbiting scroll with the back pressure chamber assembly. By doing so, since the retainer block may be fixed without a separate fastening member, an assembly process for the retainer block may be simplified.

MODE FOR THE INVENTION

Figure 1:
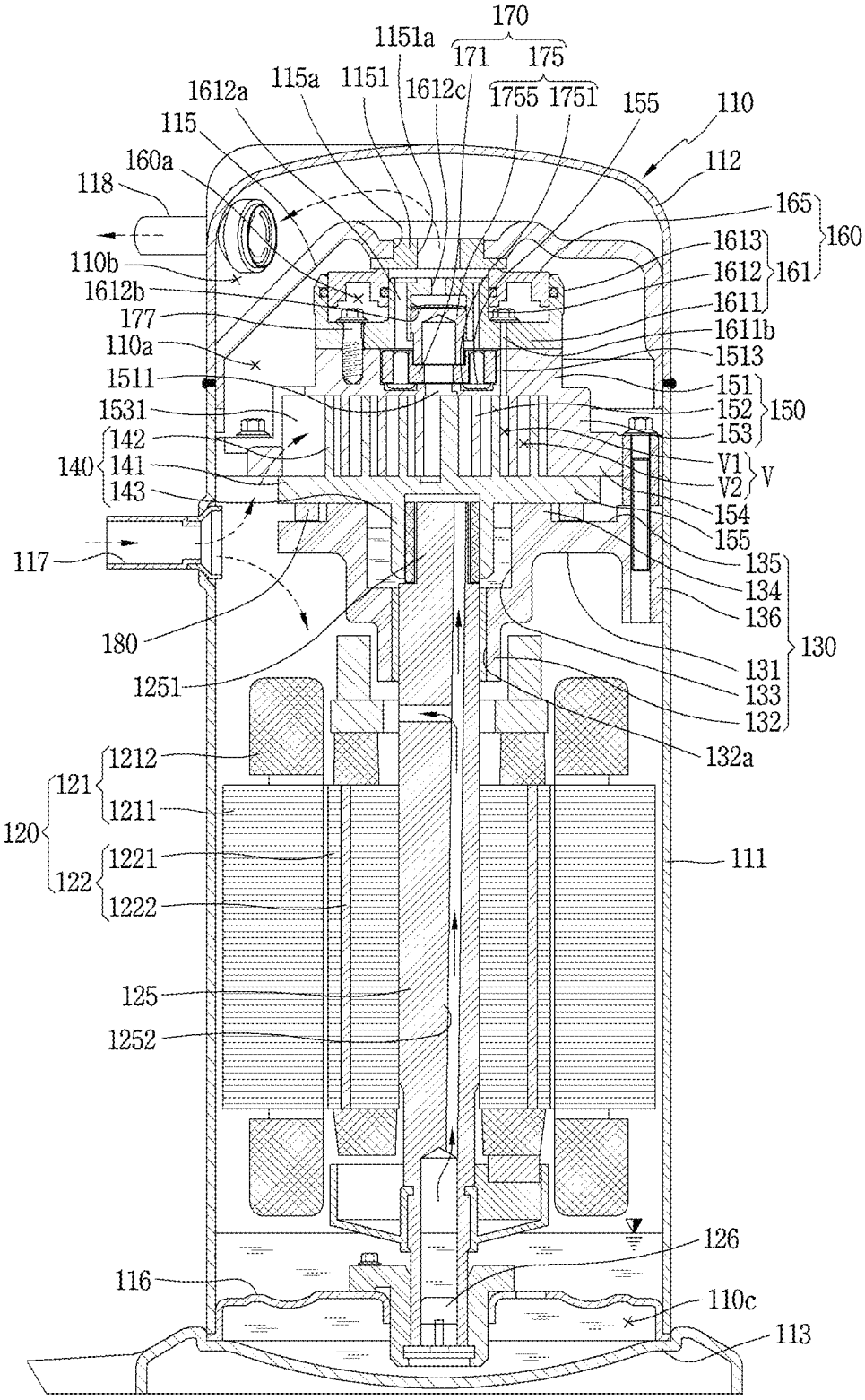
FIG. 1 is a longitudinal sectional view illustrating an inner structure of a capacity-variable scroll compressor in accordance with the present disclosure.

Description will now be given in detail of a scroll compressor according to exemplary embodiments disclosed herein, with reference to the accompanying drawings.

Typically, a scroll compressor may be classified as an open type or a hermetic type depending on whether a drive unit (motor unit) and a compression unit are all installed in an inner space of a casing. The former is a compressor in which the motor unit configuring the drive unit is provided separately from the compression unit, and the latter hermetic type is a compressor in which both the motor unit and the compression unit are disposed inside the casing. Hereinafter, a hermetic type scroll compressor will be described as an example, but it is not necessarily limited to the hermetic scroll compressor. In other words, the present disclosure may be equally applied even to the open type scroll compressor in which the motor unit and the compression unit are disposed separately from each other.

A scroll compressor is also classified as a low-pressure type compressor or a high-pressure type compressor depending on what type of pressure part is defined in an inner space of a casing, specifically, a space accommodating the motor part in a hermetic scroll compressor. In the former, the space defines a low-pressure part and a refrigerant suction pipe communicates with the space. On the other hand, in the latter, the space defines a high-pressure part and the refrigerant suction pipe is directly connected to the compression part through the casing. Hereinafter, a low-pressure type scroll compressor according to an embodiment will be described as an example. However, the present disclosure is not limited to the low-pressure type scroll compressor.

In addition, scroll compressors may be classified into a vertical scroll compressor in which a rotational shaft is disposed perpendicular to the ground and a horizontal (lateral) scroll compressor in which the rotational shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, the present disclosure may also be equally applied to the horizontal scroll compressor. Hereinafter, it will be understood that an axial direction is an axial direction of the rotational shaft, a radial direction is a radial direction of the rotational shaft, the axial direction is an up and down direction, the radial direction is a left and right direction, and an inner circumferential surface is an upper surface, respectively.

In addition, scroll compressors may be mainly divided into a tip seal type and a back pressure type depending on a method of sealing between compression chambers. The back pressure type may be divided into an orbiting back pressure type of pressing an orbiting scroll toward a non-orbiting scroll, and a non-orbiting back pressure type of pressing the non-orbiting scroll toward the orbiting scroll. Hereinafter, a scroll compressor to which a non-orbiting back pressure type is applied will be described as an example. However, the present disclosure may also be applied to the tip seal type as well as the orbiting back pressure type.

Referring to FIG. 1, a scroll compressor according to an embodiment includes a drive motor 120 constituting a motor part disposed in a lower half portion of a casing 110, and a main frame 130, an orbiting scroll 140, a non-orbiting scroll 150, a back pressure chamber assembly 160, and a valve assembly 170 that constitute a compression part disposed above the drive motor 120. The motor unit is coupled to one end of a rotational shaft 125, and the compression unit is coupled to another end of the rotational shaft 125. Accordingly, the compression unit may be connected to the motor unit by the rotational shaft 125 to be operated by rotational force of the motor unit.

Referring to FIG. 1, the casing 110 according to the embodiment includes a cylindrical shell 111, an upper cap 112, and a lower cap 113.

The cylindrical shell 111 has a cylindrical shape with upper and lower ends open, and the drive motor 120 and the main frame 130 is fitted on an inner circumferential surface of the cylindrical shell 111. A terminal bracket (not illustrated) is coupled to an upper half portion of the cylindrical shell 111. A terminal (not illustrated) for transmitting external power to the drive motor 120 is coupled through the terminal bracket. In addition, a refrigerant suction pipe 117 to be explained later is coupled to the upper half portion of the cylindrical shell 111, for example, above the drive motor 120.

The upper cap 112 is coupled to cover the open upper end of the cylindrical shell 111. The lower cap 113 is coupled to cover the lower opening of the cylindrical shell 111. A rim of a high/low pressure separation plate 115 to be explained later is inserted between the cylindrical shell 111 and the upper cap 112 to be welded on the cylindrical shell 111 and the upper cap 112. A rim of a support bracket 116 to be described later may be inserted between the cylindrical shell 111 and the lower cap 113 to be welded on the cylindrical shell 111 and the lower cap 113. Accordingly, the inner space of the casing 110 may be sealed.

The rim of the high/low pressure separation plate 115 is welded on the casing 110 as described above. A central portion of the high/low pressure separation plate 115 is bent and protrude toward an upper surface of the upper cap 112 so as to be disposed above the back pressure chamber assembly 160 to be described later. A refrigerant suction pipe 117 communicates with a space below the high/low pressure separation plate 115, and a refrigerant discharge pipe 118 communicates with a space above the high/low pressure separation plate 115. Accordingly, the low-pressure part 110*a* constituting a suction space may be disposed below the high/low pressure separation plate 115, and a high-pressure part 110*b* constituting a discharge space may be disposed above the high/low pressure separation plate 115.

In addition, a through hole 115*a* is disposed through a center of the high/low pressure separation plate 115. A sealing plate 1151 from which a floating plate 165 to be described later is detachable is inserted into the through hole 115*a*. The low-pressure part 110*a* and the high-pressure part 110*b* may be blocked from each other by attachment/detachment of the floating plate 165 and the sealing plate 1151 or may communicate with each other through a high/low pressure communication hole 1151*a* of the sealing plate 1151.

In addition, the lower cap 113 defines an oil storage space 110*c* together with the lower portion of the cylindrical shell 111 constituting the low-pressure part 110*a*. In other words, the oil storage space 110*c* is defined in the lower portion of the low-pressure part 110*a*. The oil storage space 110*c* thus defines a part of the low-pressure part 110*a*.

Referring to FIG. 1, the drive motor 120 according to the embodiment is disposed in a lower half portion of the low-pressure part 110*a* and includes a stator 121 and a rotor 122. The stator 121 is shrink-fitted to an inner wall surface of the cylindrical shell 111, and the rotor 122 is rotatably disposed inside the stator 121.

The stator 121 includes a stator core 1211 and a stator coil 1212.

The stator core 1211 is disposed in a cylindrical shape and is shrink-fitted to the inner circumferential surface of the cylindrical shell 111. The stator coil 1212 is wound around the stator core 1211 and is electrically connected to an external power source through a terminal (not illustrated) that is coupled through the casing 110.

The rotor 122 includes a rotor core 1221 and permanent magnets 1222.

The rotor core 1221 is disposed in a cylindrical shape, and is rotatably inserted into the stator core 1211 with a preset gap therebetween. The permanent magnets 1222 is embedded in the rotor core 1222 at preset intervals along a circumferential direction.

In addition, the rotational shaft 125 is press-fitted to a center of the rotor core 1221. An orbiting scroll 140 to be described later is eccentrically coupled to an upper end of the rotational shaft 125. Accordingly, the rotational force of the drive motor 120 may be transmitted to the orbiting scroll 140 through the rotational shaft 125.

An eccentric portion 1251 that is eccentrically coupled to the orbiting scroll 140 to be described later is disposed on an upper end of the rotational shaft 125. An oil pickup 126 for sucking up oil stored in the lower portion of the casing 110 may be disposed in a lower end of the rotational shaft 125. An oil passage 1252 is disposed through an inside of the rotational shaft 125 in the axial direction.

Referring to FIG. 1, the main frame 130 according to this embodiment is disposed on an upper side of the drive motor 120, and shrink-fitted to or welded on an inner wall surface of the cylindrical shell 111.

The main frame 130 includes a main flange portion 131, a main bearing portion 132, an orbiting space portion 133, a scroll support portion 134, an Oldham ring support portion 135, and a frame fixing portion 136.

The main flange portion 131 is disposed in an annular shape and accommodated in the low-pressure part 110*a* of the casing 110. An outer diameter of the main flange portion 131 is smaller than an inner diameter of the cylindrical shell 111 so that an outer circumferential surface of the main flange portion 131 is spaced apart from an inner circumferential surface of the cylindrical shell 111. However, the frame fixing portion 136 to be described later protrudes from an outer circumferential surface of the main flange portion 131 in the radial direction. The outer circumferential surface of the frame fixing portion 136 is fixedly in close contact with the inner circumferential surface of the casing 110. Accordingly, the frame 130 is fixedly coupled to the casing 110.

The main bearing portion 132 protrudes downward from a lower surface of a central part of the main flange portion 131 toward the drive motor 120. A bearing hole 132*a* configured in a cylindrical shape penetrates through the main bearing portion 132 in the axial direction. The rotational shaft 125 is inserted into an inner circumferential surface of the bearing hole 132*a* and supported in the radial direction.

The orbiting space portion 133 is recessed from the center part of the main flange portion 131 toward the main bearing portion 132 to have a predetermined depth and outer diameter. The outer diameter of the orbiting space portion 133 is larger than an outer diameter of a rotational shaft coupling portion 143 that is disposed on the orbiting scroll 140 to be described later. Accordingly, the rotational shaft coupling portion 143 can be pivotally accommodated in the orbiting space portion 133.

The scroll support portion 134 is configured in an annular shape on an upper surface of the main flange portion 131 along a circumference of the orbiting space portion 133. Accordingly, the scroll support portion 134 may support the lower surface of an orbiting end plate portion 141 to be described later in the axial direction.

The Oldham ring support portion 135 is configured in an annular shape on an upper surface of the main flange portion 131 along an outer circumferential surface of the scroll support portion 134. Accordingly, an Oldham ring 139 may be inserted into the Oldham ring supporting portion 135 to be pivotable.

The frame fixing portion 136 extends radially from an outer circumference of the Oldham ring support portion 135. The frame fixing portion 136 extends in an annular shape or extends to form a plurality of protrusions spaced apart from one another by preset distances. This embodiment illustrates an example in which the frame fixing portion 136 has a plurality of protrusions along the circumferential direction.

Referring to FIG. 1, the orbiting scroll 140 according to the embodiment is coupled to the rotational shaft 125 to be disposed between the main frame 130 and the non-orbiting scroll 150. An Oldham ring 139 which is an anti-rotation mechanism is disposed between the main frame 130 and the orbiting scroll 140. Accordingly, the orbiting scroll 140 performs an orbiting motion relative to the non-orbiting scroll 150 while its rotational motion is restricted.

In detail, the orbiting scroll 140 includes an orbiting end plate portion 141, an orbiting wrap 142, and a rotational shaft coupling portion 143.

The orbiting end plate portion 141 is configured approximately in a disk shape. An outer diameter of the orbiting end plate portion 141 is mounted on the scroll support portion 134 of the main frame 130 to be supported in the axial direction. Accordingly, the orbiting end plate portion 141 and the scroll support portion 134 facing it defines an axial bearing surface (no reference numeral given).

The orbiting wrap 142 is configured in a spiral shape by protruding from an upper surface of the orbiting end plate portion 141 facing the non-orbiting scroll 150 to a preset height. The orbiting wrap 142 is disposed to correspond to a non-orbiting wrap 152 to perform an orbiting motion by being engaged with the non-orbiting wrap 152 of the non-orbiting scroll 150 to be described later. The orbiting wrap 142 defines compression chambers V together with the non-orbiting wrap 152.

The compression chambers V include a first compression chamber V1 and a second compression chamber V2 based on the orbiting wrap 142. Each of the first compression chamber V1 and the second compression chamber V2 includes a suction pressure chamber (not illustrated), an intermediate pressure chamber (not illustrated), and a discharge pressure chamber (not illustrated) that are continuously disposed. Hereinafter, a description will be given under assumption that a compression chamber defined between an outer surface of the orbiting wrap 142 and an inner surface of the non-orbiting wrap 152 facing the same is defined as the first compression chamber V1, and a compression chamber defined between an inner surface of the orbiting wrap 142 and an outer surface of the non-orbiting wrap 152 facing the same is defined as the second compression chamber V2.

A rotational shaft coupling portion 143 protrudes from a lower surface of the orbiting end plate portion 141 toward the main frame 130. The rotational shaft coupling portion 143 is configured in a cylindrical shape, so that an orbiting bearing (not illustrated) configured as a bush bearing can be press-fitted.

Figure 2:
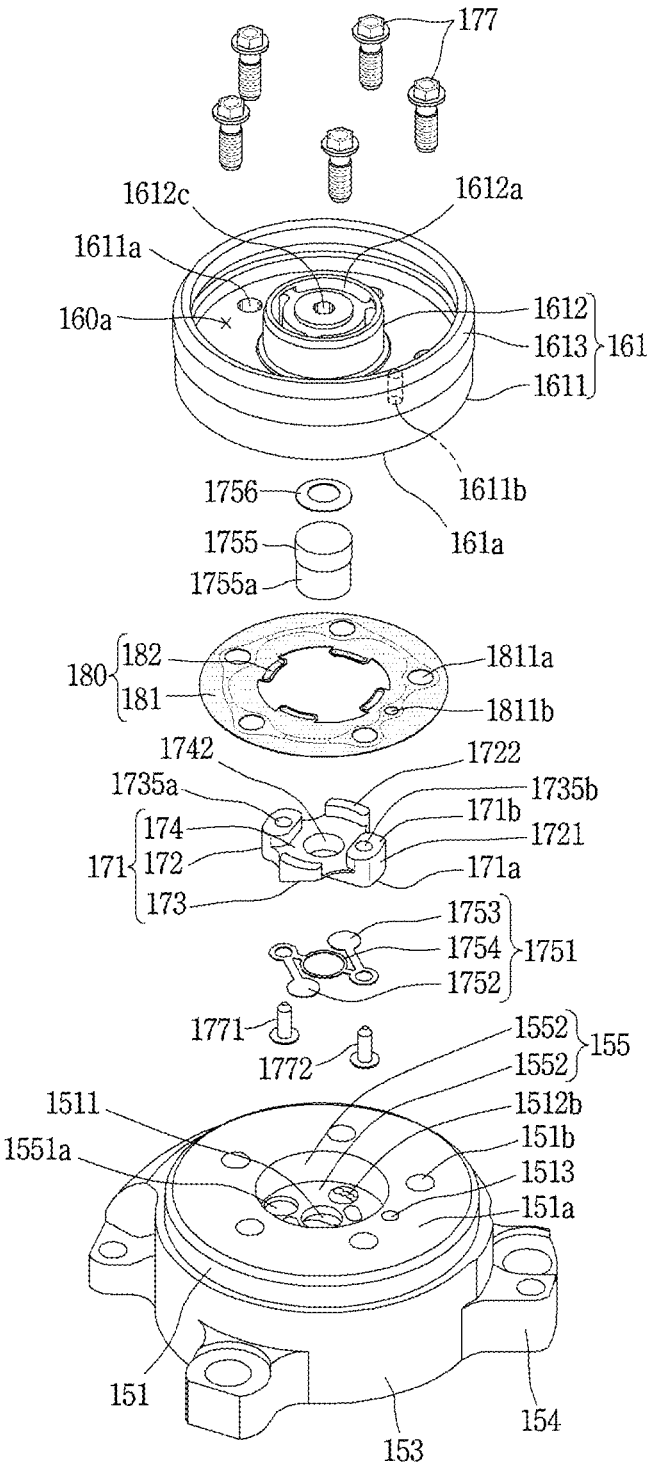
FIG. 2 is an exploded perspective view illustrating a non-orbiting scroll and a back pressure plate in FIG. 1.

Referring to FIGS. 1 and 2, the non-orbiting scroll 150 according to the embodiment may be disposed on an upper portion of the main frame 130 with interposing the orbiting scroll 140 therebetween. The non-orbiting scroll 150 is fixedly coupled to the main frame 130 or may be coupled to the main frame 130 to be movable up and down. The embodiment illustrates an example in which the non-orbiting scroll 150 is coupled to the main frame 130 to be movable relative to the main frame 130 in the axial direction.

The non-orbiting scroll 150 according to this embodiment includes a non-orbiting end plate portion 151, the non-orbiting wrap 152, a non-orbiting side wall portion 153, and a guide protrusion 154.

The non-orbiting end plate portion 151 is configured in a disk shape and disposed in a lateral direction in the low-pressure part 110*a* of the casing 110. A plurality of back pressure fastening grooves 151*b* are disposed along an edge of the non-orbiting end plate portion 151. Accordingly, back pressure fastening bolts 177 that pass through back pressure fastening holes 1611*a* of a back pressure plate 161 to be described later are fastened to the back pressure fastening grooves 151*b* of the non-orbiting end plate portion 151, such that the back pressure plate 161 can be fastened to a rear surface (upper surface) 151*a* of the non-orbiting end plate portion 151.

A discharge port 1511, bypass holes 1512, and a first back pressure hole 1513 are disposed through a central portion of the non-orbiting end plate portion 151 in the axial direction. The discharge port 1511 may be disposed at a center of the non-orbiting end plate portion 151. The bypass holes 1512 may be disposed to communicate with a compression chamber V having a pressure lower than that in a compression chamber V in communication with the discharge port 1511. The first back pressure hole 1513 may be disposed to communicate with a compression chamber V having a pressure lower than that in the compression chamber V in communication with the bypass holes 1512.

The discharge port 1511 may be located at a position where a discharge pressure chamber (no reference numeral given) of the first compression chamber V1 and a discharge pressure chamber (no reference numeral given) of the second compression chamber V2 communicate with each other. Accordingly, refrigerant compressed in the first compression chamber V1 and refrigerant compressed in the second compression chamber V2 are combined in the discharge pressure chamber and discharged to the high-pressure part 110*b* as a discharge space through the discharge port 1511.

The bypass holes 1512 include a fist bypass hole 1512*a* and a second bypass hole 1512*b*. Each of the first oil passage hole 1512*a* and the second oil passage hole 1512*b* may be provided as a single hole or may be provided in plurality. This embodiment illustrates an example in which each of the first bypass hole 1512*a* and the second bypass hole 1512*b* is provided in plurality. Accordingly, the bypass holes can be configured to be smaller than a wrap thickness of the orbiting wrap 142 and also an entire area of the bypass holes 1512 can be enlarged.

The first bypass hole 1512*a* communicates with the first compression chamber V1 and the second bypass hole 1512*b* communicates with the second compression chamber V2. The first bypass hole 1512*a* and the second bypass hole 1512*b* may be disposed at both sides of the discharge port 1511 in the circumferential direction with the discharge port 1511 located at the center, in other words, disposed at a suction side rather than the discharge port 1511. Accordingly, when refrigerant is overcompressed in each of the compression chambers V1 and V2, the refrigerant can be bypassed in advance before reaching the discharge port 1511, thereby suppressing the overcompression.

Both the first bypass hole 1512*a* and the second bypass hole 1512*b* are accommodated in a block insertion groove 155 to be described later. In other words, the block insertion groove 155 is recessed by a preset depth into the rear surface 151*a* of the non-orbiting end plate portion 151, and the first bypass hole 1512*a* and the second bypass hole 1512*b* are disposed inside the block insertion groove 155 together with the discharge port 1511. Accordingly, each length L2 of the first bypass hole 1512*a* and the second bypass hole 1512*b* can be reduced by a value that is obtained by subtracting a depth D1 of the block insertion groove 155 from a thickness H1 of the non-orbiting end plate portion 151, which may result in decreasing dead volumes in the first bypass hole 1512*a* and the second bypass hole 1512*b*. The block insertion groove 155 will be described later together with the retainer block 171.

The first back pressure hole 1513 is disposed through the non-orbiting end plate portion 151 in the axial direction, so as to communicate with a compression chamber V that forms intermediate pressure between suction pressure and discharge pressure. The first back pressure hole 1513 may be provided by one to communicate with any one of the first compression chamber V1 and the second compression chamber V2, or may be provided in plurality to communicate with the first and second compression chambers V1 and V2, respectively. The first back pressure hole 1513 is disposed outside the block insertion groove 155 described above.

The non-orbiting wrap 152 extends axially from a lower surface of the non-orbiting end plate portion 151. The non-orbiting wrap 152 may be configured in a spiral shape inside the non-orbiting side wall portion 153 to correspond to the orbiting wrap 142 so as to be engaged with the orbiting wrap 142.

The non-orbiting side wall portion 153 extends in an annular shape from a rim of a lower surface of the non-orbiting end plate portion 151 in the axial direction to surround the non-orbiting wrap 152. A suction port 1531 is disposed through one side of an outer circumferential surface of the non-orbiting side wall portion 153 in the radial direction. Accordingly, each of the first compression chamber V1 and the second compression chamber V2 compresses suctioned refrigerant as its volume decreases from an outer side to a center.

The guide protrusion 154 may extend radially from an outer circumferential surface of a lower side of the non-orbiting side wall portion 153. The guide protrusion 154 may be configured in a single annular shape or may be provided in plurality disposed at preset distances in the circumferential direction. This embodiment will be mainly described based on an example in which the plurality of guide protrusions 154 are disposed at preset distances along the circumferential direction.

Referring to FIG. 1, the back pressure chamber assembly 160 according to the embodiment is disposed at an upper side of the non-orbiting scroll 150. Accordingly, back pressure of the back pressure chamber 160*a* (to be precise, force that the back pressure acts on the back pressure chamber) is applied to the non-orbiting scroll 150. In other words, the non-orbiting scroll 150 is pressed toward the orbiting scroll 140 by the back pressure to seal both the compression chambers V1 and V2.

In detail, the back pressure chamber assembly 160 includes a back pressure plate 161 and a floating plate 165. The back pressure plate 161 is coupled to an upper surface of the non-orbiting end plate portion 151. A floating plate 165 is slidably coupled to the back pressure plate 161 to define the back pressure chamber 160*a* together with the back pressure plate 161.

The back pressure plate 161 includes a fixed plate portion 1611, a first annular wall portion 1612, and a second annular wall portion 1613.

The fixed plate portion 1611 is configured in the form of an annular plate with a hollow center. A plurality of back pressure fastening holes 1611*a* are disposed along an edge of the fixed plate portion 1611. Accordingly, the fixed plate portion 1611 is fastened to the non-orbiting scroll 150 by the back pressure fastening bolts 177 inserted through the back pressure fastening holes 1611*a*.

A plate-side back pressure hole (hereinafter, referred to as a second back pressure hole) 1611*b* is disposed through the fixed plate portion 1611 in the axial direction. The second back pressure hole 1611*a* communicates with the compression chamber V through the first back pressure hole 1513. Accordingly, the compression chamber V and the back pressure chamber 160*a* communicate with each other through the second back pressure hole 1611*a* as well as the first back pressure hole 1513.

The first annular wall portion 1612 and the second annular wall portion 1613 is disposed on an upper surface of the fixed plate portion 1611 to surround inner and outer circumferential surfaces of the fixed plate portion 1611. Accordingly, the back pressure chamber 160*a* configured in the annular shape is defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 includes an intermediate discharge port 1612*a* that communicates with the discharge port 1511 of the non-orbiting scroll 150. A valve guide groove 1612*b* into which a discharge valve 1755 is slidably inserted is disposed at an inner side of the intermediate discharge port 1612*a*. A backflow prevention hole 1612*c* is disposed in the center of the valve guide groove 1612*b*. Accordingly, the discharge valve 1755 is selectively opened and closed between the discharge port 1511 and the intermediate discharge port 1612*a* to suppress discharged refrigerant from flowing back into the compression chambers V1 and V2.

The floating plate 165 is configured in an annular shape. The floating plate 165 may be made of a lighter material than the back pressure plate 161. Accordingly, the floating plate 165 is detachably coupled to a lower surface of the high/low pressure separation plate 115 while moving in the axial direction with respect to the back pressure plate 161 depending on pressure of the back pressure chamber 160*a*. For example, when the floating plate 165 is brought into contact with the high/low pressure separation plate 115, the floating plate 165 serves to seal the low-pressure part 110*a* such that the discharged refrigerant is discharged to the high-pressure part 110*b* without leaking into the low-pressure part 110*a*.

Referring to FIGS. 1 and 2, the valve assembly 170 according to this embodiment may be disposed between the non-orbiting scroll 150 and the back pressure chamber assembly 160. For example, the valve assembly 170 may be separate from the non-orbiting scroll 150 and/or the back pressure chamber assembly 160, and inserted into the non-orbiting scroll 150 to be fixed between the non-orbiting scroll 150 and the back pressure chamber assembly 160. Accordingly, the valve assembly 170 may be easily machined or assembled.

Also, the valve assembly 170 may include a discharge valve 1755 and a bypass valve 1751, or may include not the discharge valve 1755 but the bypass valve 1751. However, depending on a shape of the discharge valve 1755, it may be described that the discharge valve 1755 is also included in the valve assembly 170. In this embodiment, whereas the discharge valve 1755 is slidably inserted into the valve guide groove 1612*b* disposed in the back pressure plate 161, the bypass valve 1751 is fixed to the retainer block 171 which will be described later. Thus, in this embodiment, it is described that the discharge valve 1755 and the bypass valve 1751 together with the retainer block 171 are included in the valve assembly 170.

In addition, the valve assembly 170 is fixedly inserted into the block insertion groove 155 of the non-orbiting end plate portion 151. In other words, the block insertion groove 155 is not included in the valve assembly 170 but is a portion into which the valve assembly 170 is inserted. Thus, in broad terms, the block insertion groove 155 may also be included in the valve assembly 170. Therefore, in the following description, the block insertion groove 155 will be described separately from the valve assembly 170, but the portion thereof that is related to the valve assembly 170 will also be described as a portion of the valve assembly 170.

Figure 3:
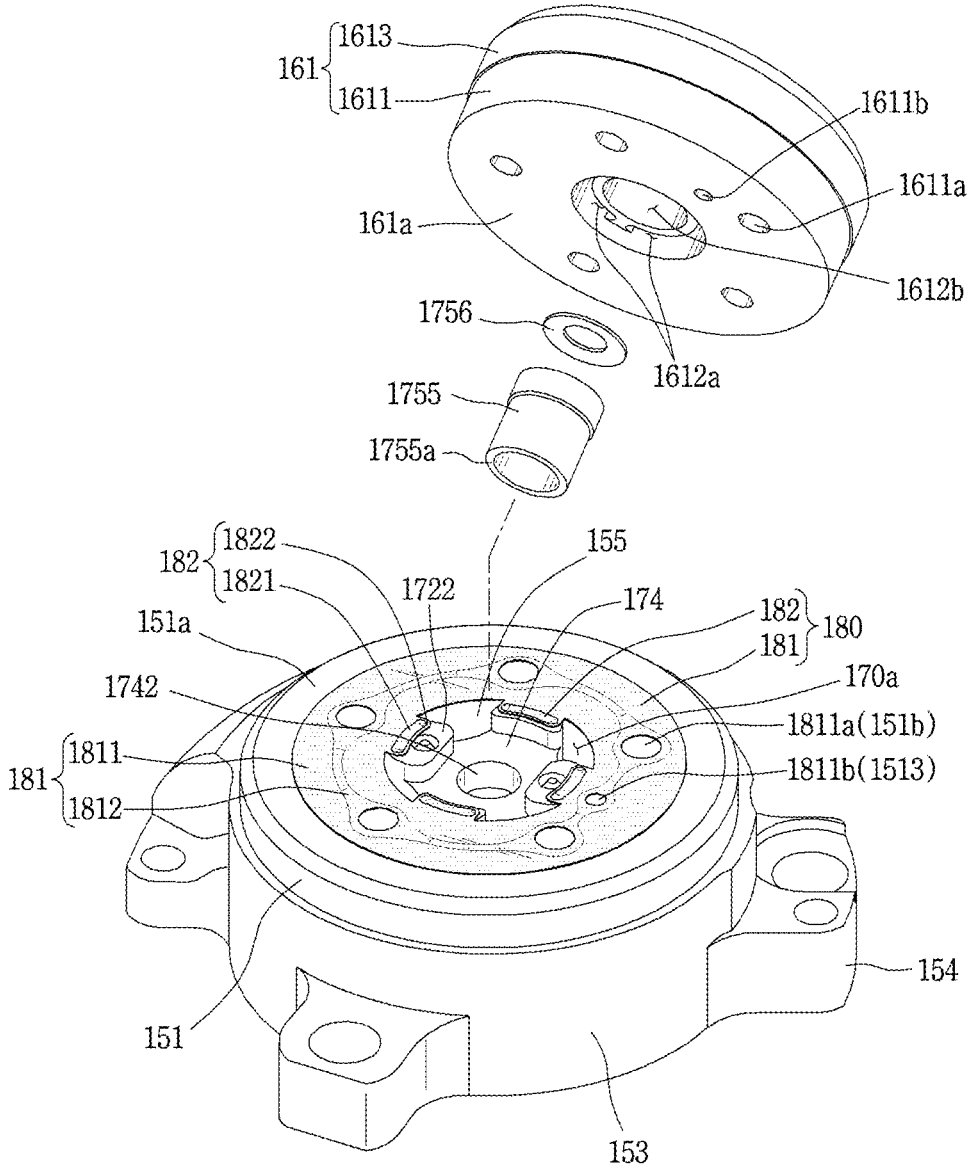
FIG. 3 is a perspective view illustrating a valve assembly assembled with a non-orbiting scroll in FIG. 2.
Figure 4:
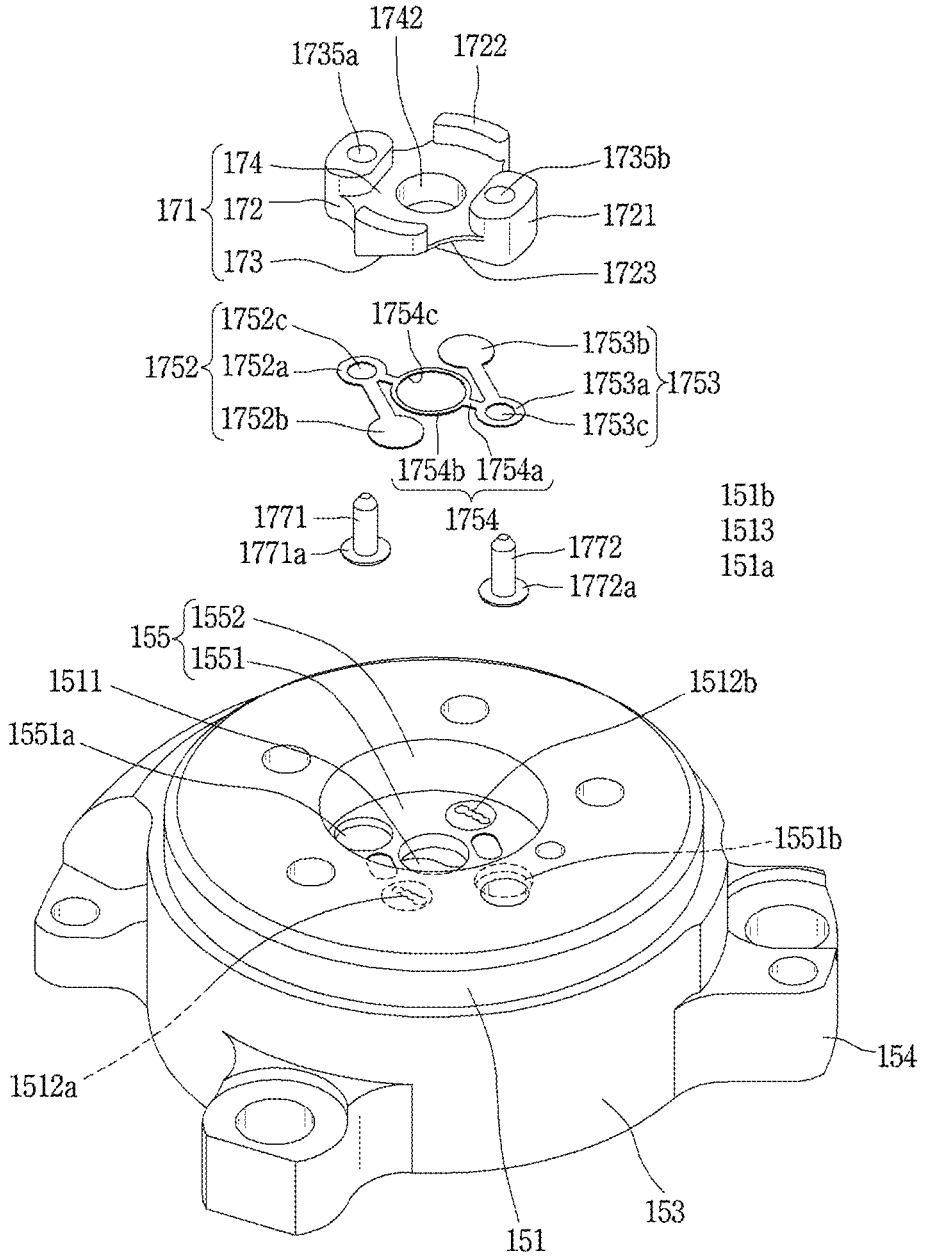
FIG. 4 is a perspective view illustrating the valve assembly of FIG. 3 exploded from a first axial side surface.
Figure 5:
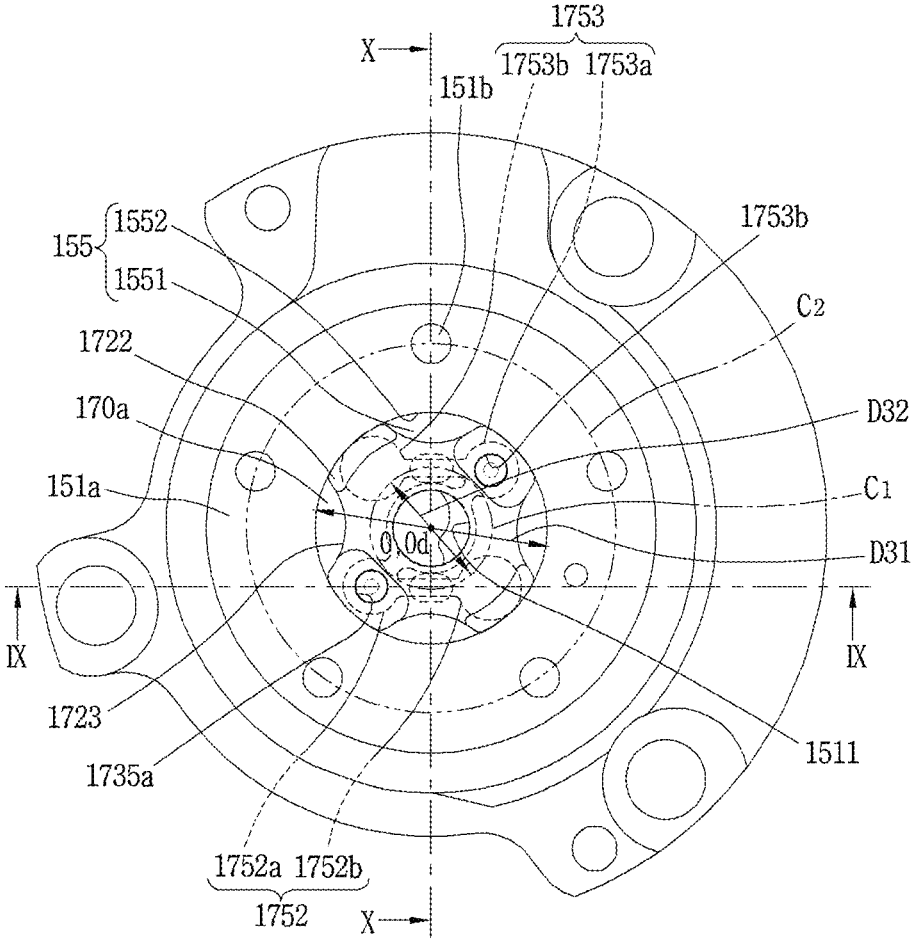
FIG. 5 is a perspective view illustrating the valve assembly assembled with the non-orbiting scroll in FIG. 3.

Referring to FIGS. 3 to 5, the block insertion groove 155 is recessed by a preset depth into the rear surface 151*a* of the non-orbiting end plate portion (or non-orbiting scroll) 151. Accordingly, the block insertion groove 155 is configured by a block seating surface 1551 defining a bottom surface, and a block accommodating surface 1552 defining the inner circumferential surface (side wall surface) of the block insertion groove 155 and surrounding the block seating surface 1551.

The block seating surface 1551 is disposed flat, and the discharge port 1511 and bypass holes 1512*a* and 1512*b* described above are respectively disposed through the block seating surface 1551. In other words, the discharge port 1511 and the bypass holes 1512*a* and 1512*b* are disposed through the block seating surface 1551 in the axial direction. Accordingly, the discharge port 1511 and the bypass holes 1512 are located inside the block insertion groove 155.

When the discharge port 1511 and the bypass holes 1512 are located inside the block insertion groove 155 like the embodiment, a length L1 of the discharge port 1511 and a length L2 of the bypass holes 1512 are reduced. Accordingly, depending on a shape of the discharge valve 1755 and/or the bypass valve 1751, dead volume in the discharge port 1511 and/or the bypass holes 1512 may be reduced. For example, in a case of a reed valve opened or closed when a first bypass valve 1752 and a second bypass valve 1753, which will be described later, are detached from or attached to upper surfaces of the first bypass hole 1512*a* and the second bypass hole 1512*b*, respectively, as lengths L2 and L2 of the first and second bypass holes 1512*a* and 1512*b*, respectively, are reduced, volume of each of the bypass holes 1512*a* and 1512*b* may be decreased, thereby reducing dead volume. This applies to a case when the bypass valve 1751 is configured as a piston valve.

In addition, a first fastening member accommodating groove 1551*a* and a second fastening member accommodating groove 1551*b* are disposed in the block seating surface 1551 to accommodate a head 1771*a* of a first valve fastening member 1771 and a head 1772*a* of a second valve fastening member 1772, the first valve fastening member 1771 and the second valve fastening member 1772 being configured to fasten the first bypass valve 1752 and the second bypass valve 1753, which will be described later, to the retainer block 171. For example, the first fastening member accommodating groove 1551*a* and the second fastening member accommodating groove 1551*b* may be disposed in the block seating surface 1551 to be recessed to have a depth equal to or greater than a height of the heads 1771*a* and 1772*a* corresponding thereto, respectively. Accordingly, a first axial side surface 171*a*, i.e., a lower surface of the retainer block 171 may be firmly supported by being in close contact with the block seating surface 1551, i.e., a bottom surface of the block insertion groove 155.

Figure 6:
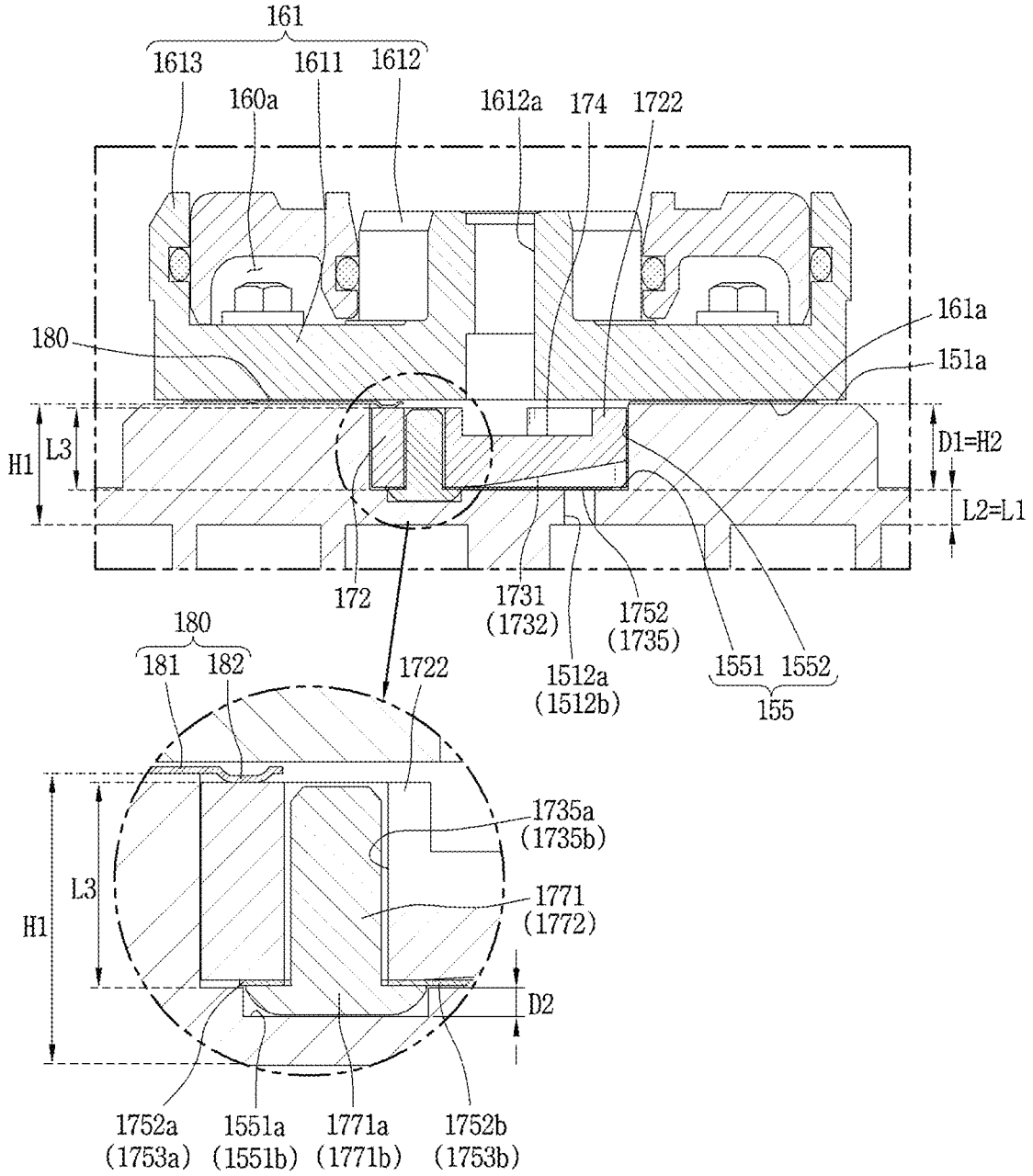
FIG. 6 is a sectional view of a back pressure assembly taken along line "IX-IX" of FIG. 5.

Referring to FIG. 6, the head 1771*a* of the first valve fastening member 1771 and the head 1772*a* of the second valve fastening member 1772 are inserted into the first fastening member accommodating groove 1551*a* and the second fastening member accommodating groove 1551*b*, respectively, as described above. Thus, the first fastening member accommodating groove 1551*a* and the second fastening member accommodating groove 1551*b* may be each configured to have a small depth. In other words, each depth D2 of the first fastening member accommodating groove 1551*a* and the second fastening member accommodating groove 1551*b* may be configured to be much smaller than each length L3 of a first valve fastening hole 1735*a* and a second valve fastening hole 1723*a* each disposed in a block body part 172 which will be described later. Accordingly, the non-orbiting end plate portion 151 on the block seating surface 1551 may be configured to have a small thickness so that the length L1 of the discharge port 1511 and/or the length L2 of the bypass holes 1512*a* and 1512*b* are small. By doing so, dead volume of the discharge port 1511 and/or the bypass holes 1512*a* and 1512*b* may be reduced.

The first fastening member accommodating groove 1551*a* and the second fastening member accommodating groove 1551*b* may be configured such that the first bypass valve 1752 and the second bypass valve 1753, which are to be described later, are located as far as possible from the first bypass hole 1512*a* and the second bypass hole 1512*b* without interfering with the discharge port 1511. For example, the first fastening member accommodating groove 1551*a* and the second fastening member accommodating groove 1551*b* may be located on a second center line CL2 perpendicular to a first center line CL1 at a center Od of the discharge port 1511, the first center line CL1 connecting the center Od of the discharge port 1511 to a center Ob1 of the first bypass hole 1512*a* and a center Ob2 of the second bypass hole 1512*b* at both sides of the center Od. Accordingly, the first bypass valve 1752 and the second bypass valve 1753, which will be described later, are located far away from the first bypass hole 1512*a* and the second bypass hole 1512*b* as possible without interfering with the discharge port 1511. By doing so, great opening/closing lengths of the first bypass valve 1752 and the second bypass valve 1753 may be secured to suppress overcompression and/or collision noise. This will be described later together with the retainer block 171 and/or the bypass valve 1751.

Figure 7:
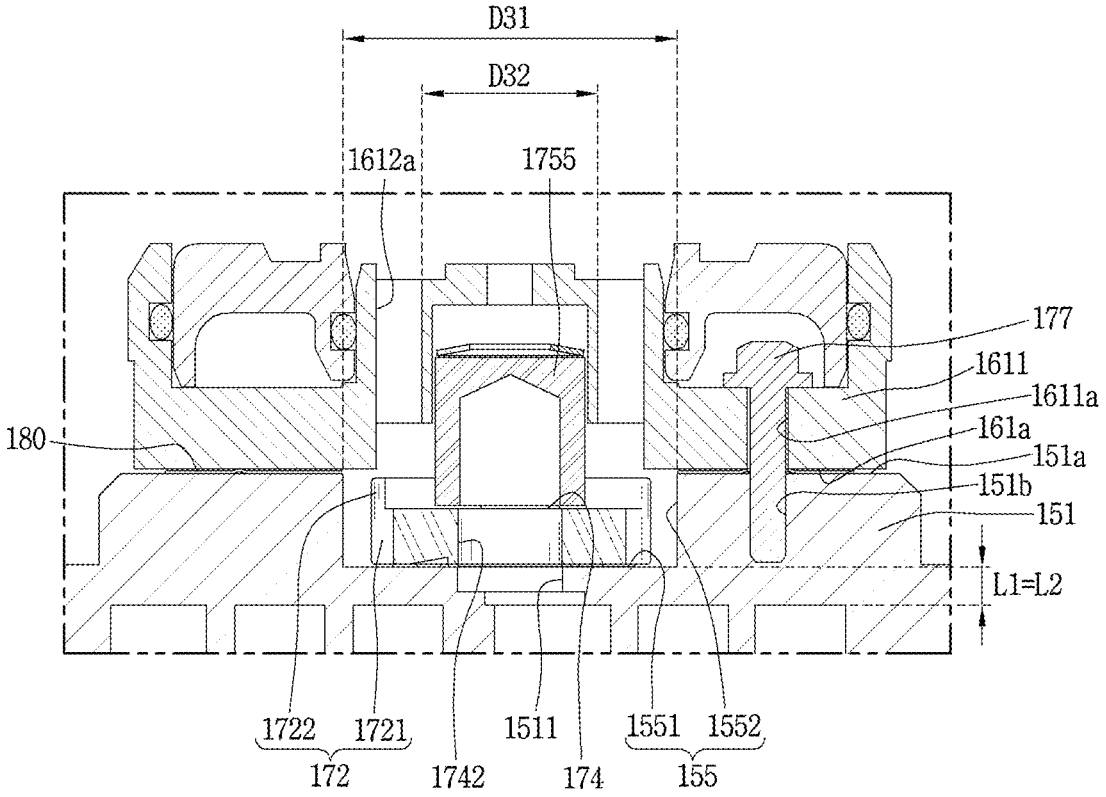
FIG. 7 is a sectional view of the back pressure assembly taken along line "X-X" of FIG. 5.

Although not illustrated, a first fastening member accommodating groove (not shown) and/or a second fastening member accommodating groove (not shown) may be disposed to be recessed in the first axial side surface 171*a* of the retainer block 171 facing the block seating surface 1551 of the block insertion groove 155, i.e., inlets of valve fastening holes 1722*a* and 1723*a*. In this case, peripheries of a valve through hole 1752*c* of the first bypass valve 1752 and the valve through hole 1753*c* of the second bypass valve 757 may be disposed to be concave to correspond to the fastening member accommodating grooves. As described above, when the first fastening member accommodating groove and/or the second fastening member accommodating groove are disposed in the first axial side surface 171*a* of the retainer block 171, the non-orbiting end plate portion 151 may be configured to have a smaller thickness compared to the above-described embodiment. By doing so, the length L1 of the discharge port 1511 and/or the lengths L2 and L2 of the bypass holes 1512*a* and 1512*b*, respectively, may be decreased compared to those in the embodiment described above with reference to FIGS. 6 and 7, thereby further reducing dead volume.

Although not illustrated, the first fastening member accommodating groove (not shown) and the second fastening member accommodating groove (not shown) may be disposed to partially correspond to the block seating surface 1551 of the block insertion groove 155 and the first axial side surface 171*a* of the retainer block 171 facing the block seating surface 1551, respectively. In this case, the non-orbiting end plate portion 151 may be configured to have a small thickness, and thus, the length L1 of the discharge port 1511 and/or the lengths L2 and L2 of the bypass holes 1512*a* and 1512*b*, respectively, may be decreased compared to those in the embodiment described above with reference to FIGS. 6 and 7, thereby further reducing dead volume.

Referring to FIGS. 4 and 5, the block accommodating surface 1552 according to this embodiment may be configured to have a circular sectional shape when projected in an axial direction. For example, the block accommodating surface 1552 may be configured to have a circular sectional shape having a center thereof at the center Od of the discharge port 1511. Accordingly, the block insertion groove 155 including the block accommodating surface 1552 may be easily machined.

In detail, the block accommodating surface 1552 may be configured to have a circular sectional shape when projected in an axial direction, and an inner diameter D31 of the block accommodating surface 1552 may be configured to be greater than a diameter D32 of a first virtual circle C1 connecting an inner circumferential surface of the intermediate discharge port 1612*a*. Accordingly, the block accommodating surface 1552 may be configured in a circular sectional shape, and a discharge guide passage 170*a*, which will be described later, defined by an inner circumferential surface of the block accommodating surface 1552 may smoothly communicate with the intermediate discharge port 1612*a*.

Also, the block accommodating surface 1552 may be disposed in a position that does not overlap the back pressure fastening grooves 151*b*. In other words, the plurality of back pressure fastening grooves 151*b* for fastening the back pressure plate 161 to the non-orbiting scroll 150 may be disposed in the rear surface 151*a* of the non-orbiting scroll 151, and the block accommodating surface 1552 defining the inner circumferential surface of the block accommodating surface 155 may be disposed to be located within a second virtual circle C2 (shown in FIG. 5) connecting centers of the back pressure coupling grooves 151*b* in a circumferential direction. Accordingly, the back pressure fastening grooves 151*b* may be located outside the block insertion groove 155. Thus, the back pressure fastening grooves 151*b* may be configured to have a great depth even when a thickness H1 of the non-orbiting end plate portion 151 in the block insertion groove 155 is small. This may secure fastening strength of the back pressure fastening bolts 177.

However, as described above, when the block insertion groove 155 including the block accommodating surface 1552 is configured in a circular sectional shape, an opening/closing length of the first bypass valve 1752 and an opening/closing length of the second bypass valve 1753 which are to be described later may not be sufficiently secured. Then, since elastic force of the first bypass valve 1752 and elastic force of the second bypass valve 1753 may increase excessively, opening operations of the first bypass valve 1752 and the second bypass valve 1753 may be delayed. Thus, overcompression may occur or a closing operation may be accelerated, thereby increasing collision noise.

Accordingly, in this embodiment, the first bypass valve 1752 and the second bypass valve 1753 may be arranged in parallel with each other, and to be inclined by a preset angle with respect to the first center line CL1 described above as shown in FIGS. 10 to 12.

In other words, the first bypass valve 1752 may be disposed to be inclined such that an angle $\alpha$1 (hereinafter, a first contained angle) of a longitudinal center line CL31 of the first bypass valve 1752 with respect to the first center line CL1 is less than a right angle in a direction toward the discharge port 1511, i.e., to be inclined at an acute angle. For example, the first contained angle $\alpha$1 may be inclined at approximately 45°. This is also applied to the second bypass valve 1753. That is, the second bypass valve 1753 may be disposed to be inclined such that an angle α2 (hereinafter, a second contained angle) of a longitudinal center line CL32 of the second bypass valve 1753 with respect to the first center line CL1 is an acute angle in a direction toward the discharge port 1511. For example, the second contained angle α2 may be inclined at approximately 45°. By doing so, while the block accommodating surface 1552 is configured in a circular sectional shape, the first bypass valve 1752 and the second bypass valve 1753 may be configured to have great opening/closing lengths as possible to thereby suppress overcompression and/or collision noise. This will be described later again together with the retainer block 171.

Referring to FIGS. 8 to 12, the valve assembly 170 according to this embodiment includes the retainer block 171 and a valve member 175. The retainer block 171 is inserted and fixed into the block insertion groove 155 included in the non-orbital end plate portion 151. The valve member 175 is supported by or fastened to the retainer block 171 to be disposed between the back pressure plate 161 and the retainer block 171 or between the non-orbital end plate portion 151 and the retainer block 171. Accordingly, the retainer block 171 and the valve member 175 are modularized into the valve assembly 170 to easily assemble the valve member 175, for example, the bypass valve 1751. In addition, as described above, the bypass valve 1751 constituting a part of the valve member 175 is inserted into the block insertion groove 155, Thus, in correspondence with the insertion, the length L2 of each of the bypass holes 1512 is decreased to thereby reduce dead volume in the bypass holes 1512.

An outer circumferential surface of the retainer block 171 according to this embodiment may be configured to have a non-circular shape. However, in some cases, an outer circumferential surface of the retainer block 171 may be configured to have a circular shape. However, as described above, as the inner circumferential surface of the block insertion groove 155 is configured to have a circular shape, it may be advantageous to configure an outer circumferential surface of the retainer block 171 to have a non-circular shape in terms of discharge of a bypassed refrigerant.

In other words, a discharge guide passage 170*a* configured to guide a refrigerant discharged from the bypass holes 1512 into the intermediate discharge port 1612*a* needs to be disposed between the inner circumferential surface of the block insertion groove 155 and the outer circumferential surface of the retainer block 171. In this case, when the outer circumferential surface of the retainer block 171 is configured to have a circular sectional shape like an outer circumferential surface of the block insertion groove 155, the retainer block 171 needs to have a small outer diameter. Thus, in correspondence with this, an opening/closing length of the bypass valve 1751 may be decreased. Accordingly, unlike the inner circumferential surface of the block insertion groove 155, the outer circumferential surface of the retainer block 171 may be configured to have a non-circular sectional shape not only to stably fix the retainer block 171, but also to increase a substantial outer diameter of the retainer block 171 to thereby secure an opening/closing length of the bypass valve 1751.

In detail, the retainer block 171 according to this embodiment includes the block body part 172, a bypass valve support portion 173, and a discharge valve accommodating part. The bypass valve support portion 173 and the discharge valve accommodating part 174 are disposed on both axial side surfaces of the block body part 172, respectively. For example, the bypass valve support portion 173 is disposed on the first axial side surface 171*a* of the retainer block 171 where the block body part 172 faces the non-orbiting scroll 150, and the discharge valve accommodating part 174 is disposed on a second axial side surface 171*b* of the retainer block 171 where the block body part 172 faces the back pressure chamber assembly 160. Thus, dead volume in the bypass holes 1512 in which a loss due to dead volume is relatively greater than that in the discharge port 1511 may be further reduced to thereby increase compressor efficiency.

Referring to FIGS. 8 to 11, the block body part 172 may include radial fixing protrusions 1721, axial fixing protrusions 1722, and discharge guide grooves 1723. The radial fixing protrusions 1721 are portions extending in a radial direction, and extend in the radial direction at a preset interval along a circumferential direction to be in close contact with or almost in close contact with an inner circumferential surface of the block insertion groove 155 to be fixed thereto. The axial fixing protrusions 1722 are portions paired with the radial fixing protrusions 1721 to axially extend from the radial fixing protrusions 1721, and are in close contact with or almost in close contact with a rear surface 161*a* of the back pressure plate 161 to be fixed to the rear surface 161*a* (or supported by a gasket which is to be described later). The discharge guide grooves 1723 are portions configured to guide a refrigerant discharged through the discharge port 1511 and/or the bypass holes 1512 to the intermediate discharge port 1612*a*, and are disposed between the radial fixing protrusions 1722 and/or the axial fixing protrusions 1721 to be spaced apart from the inner circumferential surface of the block insertion groove 155 to thereby define the discharge guide passage 170*a*.

For example, when four radial fixing protrusions 1721, four axial fixing protrusions 1722, and four discharge guide grooves 1723 are disposed, the four radial fixing protrusions 1721, the four axial fixing protrusions 1722, and the four discharge guide grooves 1723 may be defined and described as first to fourth radial fixing protrusions 1721*a* to 1721*d*, first to fourth axial fixing protrusions 1722*a* to 1722*d*, and first to fourth discharge guide grooves 1723*a* to 1723*d*, respectively, along a clockwise or counterclockwise direction. In other words, a discharge guide groove 1723 between the first radial fixing protrusion 1721*a* (or the first axial fixing protrusion) and the second radial fixing protrusion 1721*b* (or the second axial fixing protrusion) may be defined and described as the first discharge guide groove 1723*a*, a discharge guide groove 1723 between the second radial fixing protrusion 1721*b* (or the second axial fixing protrusion) and the third radial fixing protrusion 1721*c* (or the third axial fixing protrusion) may be defined and described as the second discharge guide groove 1723*b*, a discharge guide groove 1723 between the third radial fixing protrusion 1721*c* (or the third axial fixing protrusion) and the fourth radial fixing protrusion 1721*d* (or the fourth axial fixing protrusion) may be defined and described as the third discharge guide groove 1723*c*, and a discharge guide groove 1723 between the fourth radial fixing protrusion 1721*d* (or the fourth axial fixing protrusion) and the first radial fixing protrusion 1721*a* (or the first axial fixing protrusion may be defined and described as the fourth discharge guide groove 1723*d*.

Referring to FIGS. 8 to 12, the radial fixing protrusions 1721 according to this embodiment are portions constituting an outer circumferential surface of the block body part 172 and may radially extend at a preset interval along a circumferential direction. In other words, a plurality of the radial fixing protrusions 1721 (four in the drawing) may extend in the radial direction and may be disposed at equal intervals along a circumferential direction to have the discharge guide grooves 1723 therebetween. Accordingly, as described above, as the block body part 172 may be configured to have a non-circular sectional shape when projected in an axial direction, a part of the discharge guide passage 170*a* described above may be disposed between an inner circumferential surface of the block insertion groove 155 and an outer circumferential surface of the block body part 172.

As outer circumferential surfaces of the radial fixing protrusions 1721 are almost in contact with the inner circumferential surface of the block insertion groove 155, the outer circumferential surfaces of the radial fixing protrusions 1721 may be configured to have a curvature almost same as that of the inner circumferential surface of the block insertion groove 155. Accordingly, a contact area between the outer circumferential surfaces of the radial fixing protrusions 1721 and the inner circumferential surface of the block insertion groove 155 may be increased to thereby stably support the block main body 172 in the block insertion groove 155 in a transverse direction (or a radial direction).

In detail, each length L5 of the radial fixing protrusions 1721 may be equal to or less than each length L6 of the discharge guide grooves 1723. In other words, since the radial fixing protrusions 1721 correspond to a support surface with respect to the block body part 172, it may be advantageous to configure the radial fixing protrusions 1721 to be wide as possible. However, since the radial fixing protrusions 1721 may operate as a kind of obstacle with respect to the discharge guide passage 170*a*, it is advantageous to dispose the radial fixing protrusions 1721 narrowly as possible in terms of discharge of a refrigerant. However, in this embodiment, since the plurality of radial fixing protrusions 1721 are disposed at equal intervals along a circumferential direction, even when each length L5 of the radial fixing protrusions 1721 is equal to or slightly less than each length L6 of the discharge guide grooves 1723, the block body part 172 may be comparatively stably supported with respect to the block seating surface 1551 and/or the block accommodating surface 1552. Accordingly, when each length L5 of the radial fixing protrusions 1721 is less than or equal to each length L6 of the discharge guide grooves 1723, the block body part 172 may be stably supported and the discharge guide passage 170*a* may also have a large sectional area as possible.

Referring to FIGS. 8 to 12, the axial fixing protrusions 1722 are portions constituting the second axial side surface 171*b* of the retainer block 171 (or the block body part), and may be disposed to extend from the radial fixing protrusions 1721 in an axial direction, respectively. Accordingly, an axial sectional shape of the axial fixing protrusions 1722 may be configured to be nearly identical to an axial sectional shape of the radial fixing protrusions 1721.

Like the radial fixing protrusions 1721, the plurality of axial fixing protrusions 1722 are disposed to have the discharge guide grooves 1723 therebetween and extend in an axial direction. The plurality of axial fixing protrusions 1722 may be configured to have different axial sectional areas. In other words, axial sectional areas of block support surfaces 1726*a* to 1726*d* constituting upper surfaces of the axial fixing protrusions 1722 (or a second axial side surface of the retainer block) may be different from each other.

For example, among the plurality of axial fixing protrusions 1722, axial sectional areas of the block support surfaces 1726*b* and 1726*d* of the axial fixing protrusions 1722*b* and 1722*d* (the second and fourth axial fixing protrusions) in which the first valve fastening hole 1735*a* and a second valve fastening hole 1735*b*, which will be described later, are not disposed may be smaller than axial sectional areas of the block support surfaces 1726*a* and 1726*c* of the axial fixing protrusions 1722*a* and 1722*c* (the first and third axial fixing protrusions) in which the first valve fastening hole 1735*a* and the second valve fastening hole 1735*b* are disposed. In other words, axial sectional areas of the axial fixing protrusions 1722*b* and 1722*d* extending from the radial fixing protrusions 1721*b* and 1721*d* (the second and/or fourth radial fixing protrusions) in which a first valve opening/closing surface 1731*b* and/or a second valve opening/closing surface 1732*b*, which will be described later, are disposed may be smaller than axial sectional areas of the axial fixing protrusions 1722*a* and 17722*c* extending from the radial fixing protrusions 1721*a* and 1721*c* (the first and/or third radial fixing protrusions) in which a first valve fixing surface 1731*a* and/or a second valve fixing surface 1732*a* are disposed. Accordingly, since a sectional area of the discharge valve accommodating part 174, which will be described later, is expanded to reduce discharge resistance in the discharge valve accommodating part 174, a refrigerant discharged through the discharge port 1511 and/or the bypass holes 1512 may be moved quickly through the intermediate discharge port 1612*a*.

Although not shown in the drawing, the plurality of axial fixing protrusions 1722 may be configured to have a same axial sectional area. For example, regardless of whether the first valve fastening hole 1735*a* and the second valve fastening hole 1735*b*, which will be described later, are present or penetrate through the block support surfaces 1726*a* to 1726*d*, the first to fourth axial fixing protrusions 1722*a* to 1722*d* may be configured to have a same axial sectional area. Accordingly, since the block body part 172 receives almost same axial support force in a circumferential direction by the back pressure chamber assembly 160 (precisely, a block support portion of a gasket), the block body part 172 may be stably fixed, thereby stabilizing behavior of the discharge valve 1755 as well as that of the bypass valve 1751.

In addition, the plurality of axial fixing protrusions 1722 may be configured to have a same height. In other words, the block support surface 1726*a* to 1726*d* may be located at a same height in an axial direction. Accordingly, the block body part 172 may be stably fixed by receiving uniform support force by the back pressure plate 161 (e.g., the block support portion of the gasket).

Additionally, the block support surfaces 1726*a* and 1726*c* of the axial fixing protrusions 1722*a* and 1722*c* may be located at a height less than or equal to a height of an upper end of the block accommodating surface 1552. For example, a height H2 from the block seating surface 1551 to each of the block support surfaces 1726*a* to 1726*d* may be less than or equal to the depth D1 of the block insertion groove 155. Accordingly, the retainer block 171 may be fixed between the non-orbiting scroll 150 and the back pressure chamber assembly 160, and the non-orbiting scroll 150 and the back pressure chamber assembly 160 may be in close contact with each other to have a gasket 180, which will be described later, therebetween to tightly seal a space between both back pressure holes 1513 and 1611*b*.

However, in this embodiment, an example in which a height of each of the plurality of axial fixing protrusions 1722, i.e., a height H2 of each of the block support surfaces 1726*a* to 1726*d* is slightly less than the depth D1 of the block insertion groove 155 is shown. Accordingly, a block support portion 182 extending toward the axial fixing protrusions 1722 of the block body part 172 to axially support the block body part 172 may extend on an inner circumferential surface of the gasket 180 which will be described later. The block support portion 182 of the gasket 180 will be described again later.

Referring to FIGS. 8 to 12, as described above, the discharge guide grooves 1723 may be disposed between the plurality of radial fixing protrusions 1721. In other words, the discharge guide grooves 1723 may be defined as a space between radial fixing protrusions 1721 at both sides spaced apart from each other in a circumferential direction. Accordingly, inner circumferential surfaces of the discharge guide grooves 1723 constitute an outer circumferential surface of the block body part 172, together with the outer circumferential surfaces of the radial fixing protrusions 1721.

The discharge guide grooves 1723 may be configured as a linear surface or a curved surface. In this embodiment, an example in which the discharge guide grooves 1723 are configured as a curved surface is shown. Thus, the discharge guide grooves 1723 may be easily machined.

Additionally, the discharge guide grooves 1723 may be configured to be convex to have a same curvature as that of the block accommodating surface 1552, or to be concave in a direction away from the block accommodating surface 1552. In this embodiment, an example in which the discharge guide grooves 1723 are configured to be concave is shown. Accordingly, the discharge guide grooves 1723 may be easily machined and central portions of the discharge guide grooves 1723 may be configured to have a great depth, and in correspondence with this, a large sectional area of the discharge guide passage 170*a* may be secured.

Figure 8:
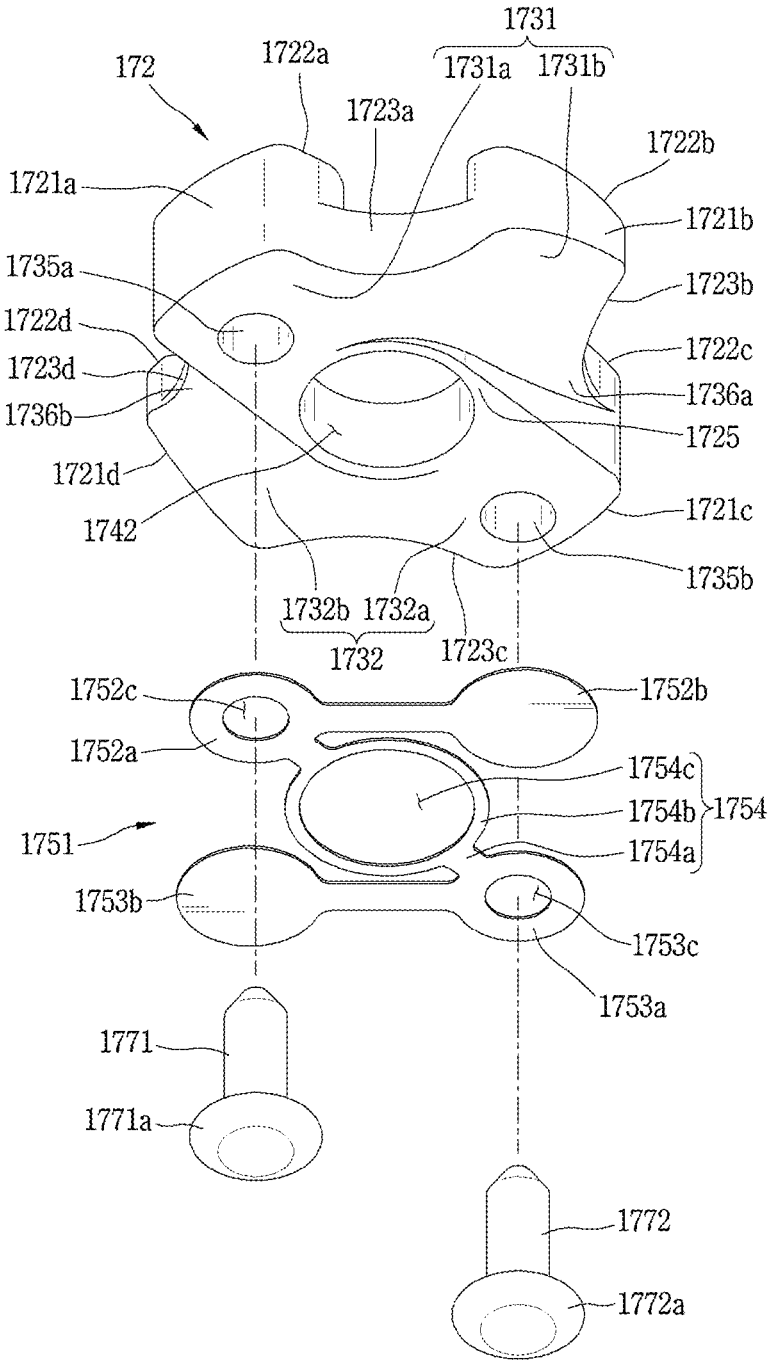
FIG. 8 is a perspective view illustrating a bypass valve disassembled from a retainer block.
Figure 9:
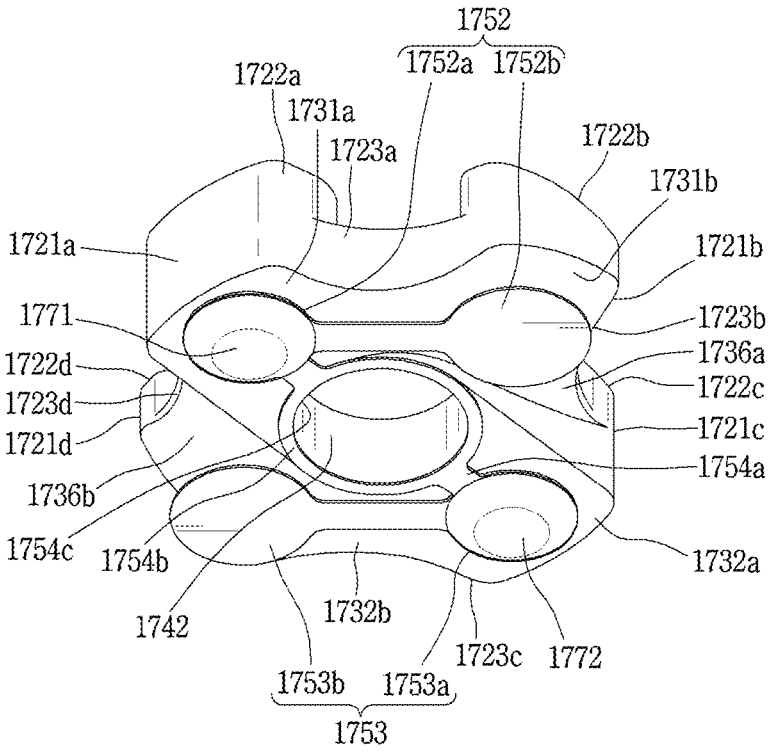
FIG. 9 is a perspective view illustrating the bypass valve assembled to the retainer block.
Figure 10:
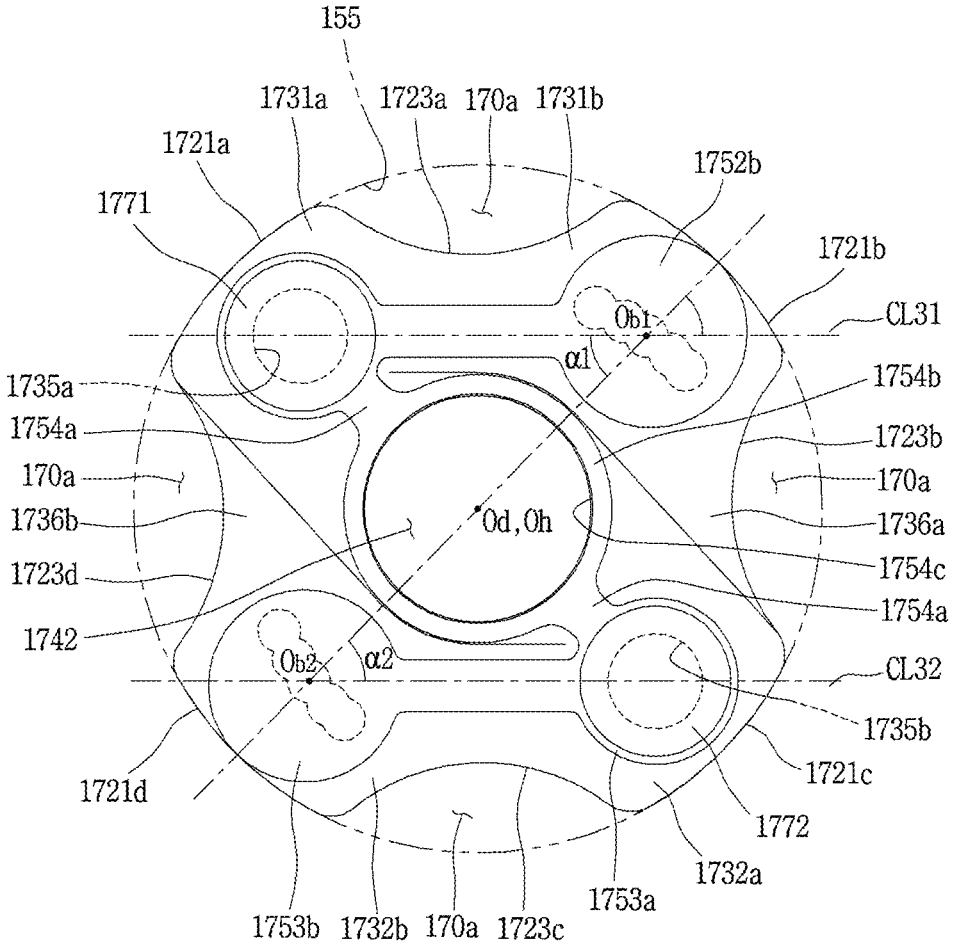
FIG. 10 is a bottom view of FIG. 9.

Referring to FIGS. 8 to 10, the bypass valve support portion 173 according to this embodiment may be disposed on the first axial side surface 171*a* of the retainer block 171 as described above, and may be disposed at both sides with reference to a discharge guide hole 1742, which will be described later, in a traverse direction. For example, the bypass valve support 173 may include a first valve support portion 1731 and a second valve support 1732, and the first valve support 1731 and the second valve support 1732 may be disposed at both sides with reference to the discharge guide hole 1742, which will be described later, in a traverse direction. Assembly positions of the first valve support 1731 and the second valve support 1732 are opposite to each other, and their shapes and operations are anti-symmetrical to each other. Thus, hereinafter, a first valve support 1741 is mainly to be described, and the second valve support 1742 is to be briefly described with reference to the description about the first valve support portion 1731.

The first valve support portion 1731 includes the first valve fixing surface 1731*a* and the first valve opening/closing surface 1731*b*. The first valve fixing surface 1731*a* is a surface to which a first fixing portion 1752*a* of the first bypass valve 1752, which will be described later, is fastened. The first valve opening/closing surface 1731*b* is a surface to which a first opening/closing portion 1752*b* of the first bypass valve 1752, which will be described later, is detachably attached to limit an opening amount.

The first valve support portion 1731 may be disposed across two radial fixing protrusions 1721 and two discharge guide grooves 1723 neighboring each other. For example, among two adjacent radial fixing protrusions 1721, the first valve fixing surface 1731*a* may be disposed on one radial fixing protrusion 1721, and the first valve opening/closing surface 1731*b* may be disposed across another radial fixing protrusion 1721 and discharge guide grooves 1723 located at both sides to have the another radial fixing protrusion 1721 therebetween.

In other words, the first valve fixing surface 1731*a* may be disposed on one axial side surface of the first radial fixing protrusion 1721*a*, and the first valve opening/closing surface 1731*b* may be disposed across the second radial fixing protrusion 1721*b* and the first and second discharge grooves 1723*a* and 1723*b* located at both sides of the second radial fixing protrusion 1721*b*, respectively. Thus, the first valve fixing surface 1731*a* may be disposed narrowly, whereas the first valve opening/closing surface 1731*b* may be disposed more widely than the first valve fixing surface 1731*a*. Accordingly, the first bypass valve 1752, which will be described later, may be secured to have a great length even inside the block insertion groove 155 having a small width.

In detail, the first valve fixing surface 1731*a* is disposed to be flat on the first axial side surface 171*a* of the retainer block 171 (or the block body part) facing the block seating surface 1551, that is, a lower surface of the first radial fixing protrusion 1721*a*. Accordingly, the first valve fixing surface 1731*a* may be fixedly in close contact with the rear surface 151*a* of the non-orbiting end plate portion 151, together with the first fixing portion 1752*a* of the bypass valve 1751 which will be described later.

One end of the first valve fastening hole 1735*a* is disposed on the first valve fixing surface 1731*a*. In other words, the first valve fastening hole 1735*a* may penetrate through the first radial fixing protrusion 1721*a* in an axial direction to have one end disposed through the first valve fixing surface 1731*a* and another end disposed through an upper surface of the first axial fixing protrusion 1722*a*, i.e., the first block support surface 1726*a* which will be described later. Thus, the first bypass valve 1752 may be stably fixed by being brought into close contact with the first valve fixing surface 1731*a* facing the block seating surface 1551.

Although not shown in the drawing, a first valve fastening groove (not shown) may be disposed to be recessed in the first valve fixing surface 1731*a* by a preset depth along an axial direction toward the first block support surface 1726*a* which will be described later. Hereinafter, for convenience, it is described that the first valve fastening groove is included in the first valve fastening hole 1735*a*.

The first valve fastening member 1771 penetrating through the first fixing portion 1752*a* of the first bypass valve 1752 which will be described later, e.g., a fastening bolt or a fastening rivet is fixedly inserted into the first valve fastening hole 1735*a*. In this embodiment, an example in which the fastening rivet is applied is illustrated. Accordingly, in a state of supporting the first bypass valve 1751 on the first valve fixing surface 1731*a* of the first radial fixing protrusion 1721*a*, the head 1771*a* of the first valve fastening member 1771 may be inserted and fastened into the first valve fastening hole 1735*a* from an upper side toward a lower side, i.e., from the non-orbiting scroll 150 toward the back pressure chamber assembly 160.

In this case, the head 1771*a* of the first valve fastening member 1771 is inserted and buried into the first fastening member accommodating groove 1551*a* of the block insertion groove 155 described above. Thus, the head 1771*a* of the first valve fastening member 1771 may protrude toward a lower side of the block body part 172, and the block body part 172 may be fixed by the head 1771*a* of the first valve fastening member 1771 to be in close contact with a bottom surface of the block insertion groove 155 without being lifted. In addition, the non-orbital end plate portion 151 may be disposed to have a small thickness in the block insertion groove 155, and in correspondence with this, lengths of the discharge port 1511 and/or the bypass holes 1512*a* and

1512*b* may be reduced. Thus, dead volume in the discharge ports 1511 and/or the bypass holes 1512*a* and 1512*b* may be reduced.

Referring to FIGS. 10 to 12A, the first valve opening/closing surface 1731*b* may be disposed to be inclined with respect to the second center line CL2 which will be described later. For example, when projected in an axial direction, the first valve opening/closing surface 1731*b* may be disposed to be inclined from the first radial fixing protrusion 1721*a*, on which the first valve fixing surface 1731*a* is disposed, toward the neighboring second radial fixing protrusion 1721*b*, at an acute angle approximately smaller than a right angle with respect to the second center line CL2. Accordingly, the block insertion groove 155 may be configured to have a circular shape, and a length L4 of the first valve opening/closing surface 1731*b* may be configured to be as great as possible.

In addition, the first valve opening/closing surface 1731*b* may be disposed to be gradually away from the block seating surface (1551) when being far apart from the first valve fixing surface 1731*a*. For example, the first valve opening/closing surface 1731*b* may be configured to be inclined or curved. Accordingly, the first bypass valve 1752 may rotate around the first valve fixing surface 1731*a* to be attached to or detached from the first valve opening/closing surface 1731*b*, thereby limiting an opening amount of the first bypass valve 1752.

In addition, the first valve opening/closing surface 1731*b* may have a larger sectional area toward the first valve fixing surface 1731*a* than that toward an opposite side, i.e., toward the second radial fixing protrusion 1721*b*. For example, as described above, the first valve opening/closing surface 1731*b* may be disposed to extend from an end of the first radial fixing protrusion 1721*a* toward the first discharge guide groove 1723*a* to the second discharge guide groove 1723*b* via the second radial fixing protrusion 1721*b*. Accordingly, an end of the first valve opening/closing surface 1731*b* at an opposite side, i.e., at a side opposite to the first valve fixing surface 1731*a* defines a portion from an outer circumferential surface of the second radial fixing protrusion 1721*b* to an end of the second discharge guide groove 1723*b* toward the third radial fixing protrusion 1721*c*. Thus, a sectional area of the first valve opening/closing surface 1731*b* may be configured to large toward the second radial fixing protrusion 1721*b*.

In other words, the first valve opening/closing surface 1731*b* may be disposed to overlap the first discharge guide groove 1723*a* and the second discharge guide groove 1723*b* in longitudinal and width directions, and a first discharge guide surface 1736*a* configured to quickly guide a refrigerant bypassed through the first bypass hole 1512*a* toward the intermediate discharge port 1612*a* may be disposed at an end of the second radial fixing protrusion 1721*b* of the first valve opening/closing surface 1731*b* at a side opposite to the first radial fixing protrusion 1721*a*.

For example, the first discharge guide surface 1736*a* may longitudinally extend from a longitudinal center of the first valve opening/closing surface 1731*b* toward the second discharge guide groove 1723*b*, and simultaneously, extend toward a circumferential side surface of the third radial fixing protrusion 1721 in a width direction. Accordingly, when projected in the axial direction, the first discharge guide surface 1736*a* may be configured in an approximately triangular shape having a large area toward the second discharge guide groove 1723*b* to expand the discharge guide passage 170*a* to thereby allow a bypassed refrigerant to quickly move toward the intermediate discharge port 1612*a*.

Figure 12A:
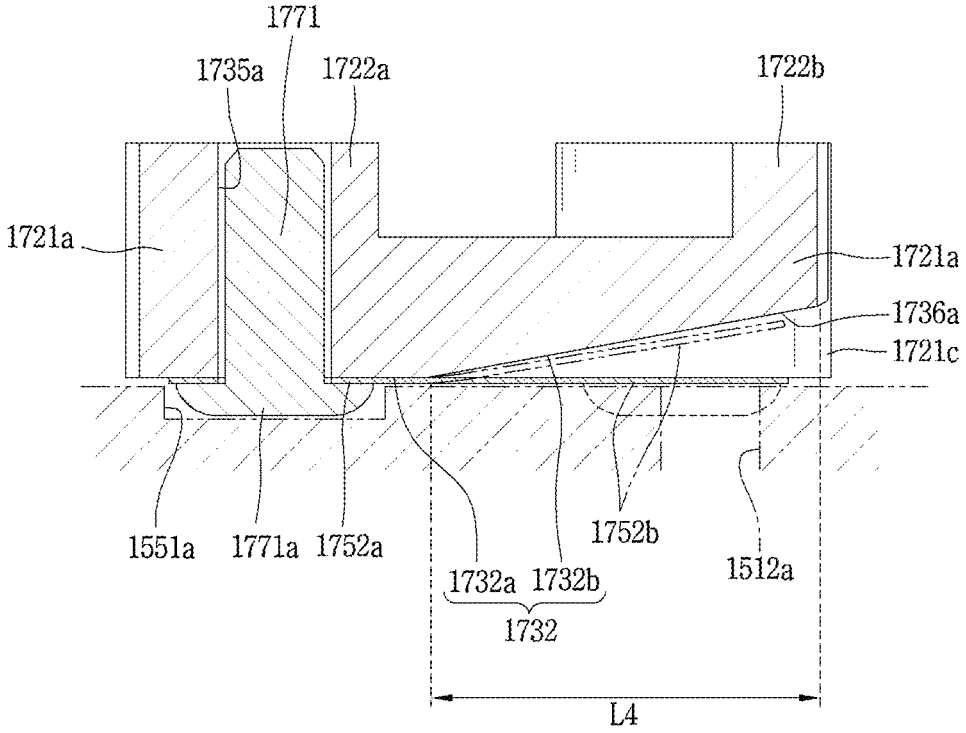
FIGS. 12A and 12B are sectional views taken along lines "XI-XI" and "XII-XII" shown in FIG. 11, respectively.
Figure 12B:
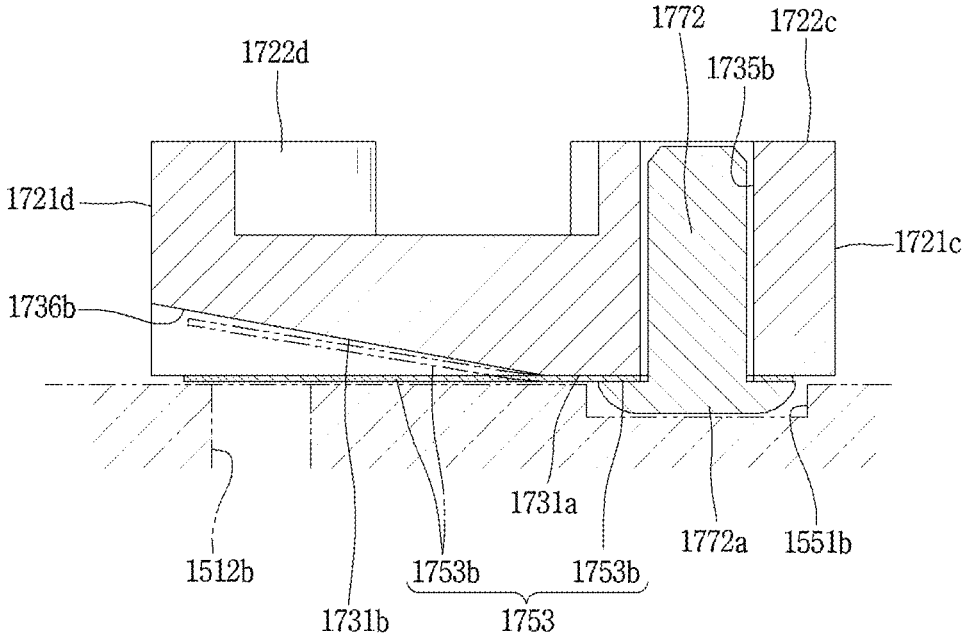

Meanwhile, referring to FIGS. 10 and 12B, the second valve support portion 1732 includes the second valve fixing surface 1732*a* and the second valve opening/closing surface 1732*b*. As described above, the second valve support portion 1732 may be configured to be almost identical to the first valve support portion 1731. For example, the second valve fixing surface 1732*a* may correspond to the first valve fixing surface 1731*a*, and the second valve opening/closing surface 1732*b* may correspond to the first valve opening/closing surface 1731*b*. Accordingly, a description about the second valve fixing surface 1732*a* and the second valve opening/closing surface 1732*b* may be replaced by a description about the first valve fixing surface 1731*a* and the first valve opening/closing surface 1731*b*.

However, the second valve fixing surface 1732*a* may be disposed on a lower surface of the third radial fixing protrusion 1721*c*, and the second valve opening/closing surface 1732*b* may extend from the third radial fixing protrusion 1721*c* toward the fourth radial fixing protrusion 1721*d*. In other words, the second valve fixing surface 1732*a* may be disposed to apart from the first valve fixing surface 1731*a* by approximately an angle of 180° in a circumferential direction, and the second valve opening/closing surface 1732*b* may be disposed to be apart from the first valve opening/closing surface 1731*b* by approximately an angle of 180° in a circumferential direction.

The second valve fixing surface 1732*a* may be disposed to have a height and a shape each same or nearly same as those of the first valve fixing surface 1731*a* to be connected to each other. For example, the second valve fixing surface 1732*a* may be disposed to be anti-symmetrically to the first valve fixing surface 1731*a* with reference to a center of the block body part 172, i.e., a center Oh of the discharge guide hole 1742 to be connected to the first valve fixing surface 1731*a*. Accordingly, the second valve fixing surface 1732*a* may define a block fixing surface 1725 constituting the first axial side surface 171*a* of the retainer block 171 (or the block body part), together with the first valve fixing surface 1731*a*.

In addition, as the second valve fixing surface 1732*a* may be disposed flatly like the first valve fixing surface 1731*a* to be connected thereto, the first axial side surface 171*a* of the retainer block 171 (or the block body part) may be configured such that the block fixing surface 1725 in contact with the block seating surface 1551 of the non-orbiting scroll 150 has a relatively large size. In other words, the block fixing surface 1725 may be disposed to have a length in a first traverse direction connecting the first valve fastening hole 1735*a* to the second valve fastening hole 1735*b* which is to be described later, and a length in a second traverse direction (width) perpendicular to the first traverse direction may be configured to be approximately constant (excluding sections included in the first valve opening/closing surface 1731*b* and the second valve opening/closing surface 1732*b*). Accordingly, the retainer block 171 (or the block body part) may be supported widely with respect to the block seating surface 1551, and also in close contact with the block seating surface 1551 equally at both sides to stably fix the retainer block 171 (or the block body part) to the non-orbiting scroll 150.

The discharge guide hole 1742 to be described later may be disposed through a center of the block fixing surface 1725 in an axial direction. For example, a length of the block fixing surface 1725 in the second traverse direction may be disposed to be slightly greater than an inner diameter of the discharge guide hole 1742. Accordingly, a part of the block fixing surface 1725 is may be disposed along a periphery of the discharge guide hole 1742 to tightly seal the discharge port 1511. In addition, a valve connection portion 1754, which will be described later, in the bypass valve 1751 may be axially supported between the non-orbiting scroll 150 and the retainer block 171 (or the block body part). The valve connection portion 1754 will be described later again together with the bypass valve 1751.

The second valve fixing surface 1732*a* may be disposed symmetrically to the first valve fixing surface 1731*a* with respect to the first center line CL1 passing through the center Ob1 of the first bypass hole 1512*a* and the center Ob2 of the second bypass hole 1512*b*. The second valve opening/closing surface 1732*b* may be disposed anti-symmetrically to the first valve opening/closing surface 1731*b* with respect to the second center line CL2 perpendicular to the first center line CL1 at the center Oh of the discharge guide hole 1742 which will be described later. Accordingly, the second valve support portion 1732 may be disposed at regular intervals along a clockwise (or counterclockwise) direction, together with the first valve support portion 1731. By doing so, the first valve fastening hole 1735*a* may be located far away from the first bypass hole 1512*a*, and correspondingly, the first bypass valve (1752) may be secured to have a great opening/closing length.

In addition, the second valve fastening hole 1735*b* may be axially disposed through the second valve fixing surface 1732*a*, and a second discharge guide surface 1736*b* may be disposed at an end of the second valve opening/closing surface 1732*b*, i.e., at a side opposite to the second valve fixing surface 1732*a*. The second valve fastening hole 1735*b* may be disposed all through the fourth block support surface 1726*d*, which will be described later, and the second discharge guide surface 1736*b* may be disposed to extend toward the fourth discharge guide groove 1723*d*. Shapes and corresponding operational effects of the second valve fastening hole 1735*b* and the second discharge guide surface 1736*b* are almost identical to those of the first valve fastening hole 1735*a* and the first discharge guiding surface 1736*a* described above, respectively. Thus, a description about the second valve fastening hole 1735*b* and the second discharge guide surface 1736*b* will be replaced by the description about the first valve fastening hole 1735*a* and the first discharge guide surface 1736*a*.

Figure 11:
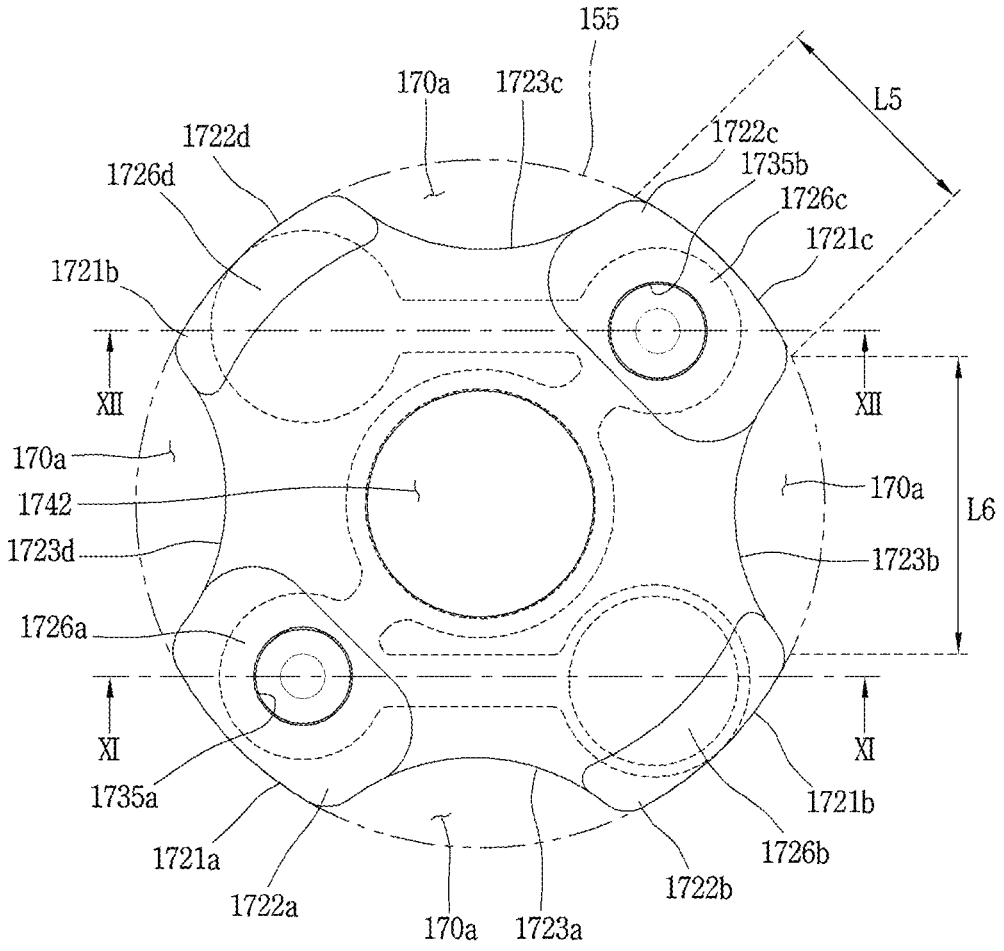
FIG. 11 is a planar view of FIG. 9.

Referring to FIG. 11, the discharge valve accommodating part 174 is disposed in a substantially central portion of the block body part 172. Accordingly, the discharge valve 1755 can be accommodated in the discharge valve accommodating part 174 to open and close the discharge port 1511 that is located in the center of the non-orbiting end plate portion 151.

The discharge valve accommodating part 174 may be recessed by a preset depth into one side surface of the block body part 172, or may be disposed through the block body part 172. Accordingly, an opening/closing position of an opening/closing surface 1751*a* of the discharge valve 1755 may be determined depending on the shape of the discharge valve accommodating part 174.

For example, when a central portion of the discharge valve accommodating part 174 is disposed to be recessed, the discharge valve 1755 is in contact with a bottom surface of the discharge valve accommodating part 174 to constitute a valve seat surface, and when the central portion of the discharge valve accommodating part 174 is penetrated therethrough, the discharge valve 1755 comes into contact with the rear surface 151*a* of the non-orbiting end plate portion 151 to define a valve seat surface. In this embodiment, an example in which the discharge valve accommodating part 174 is recessed in one side surface of the block body part 172 toward the rear surface 151*a* of the non-orbiting end plate portion 151 by a preset depth, e.g., by a height of the axial fixing protrusions 1722 is shown.

In detail, the discharge valve accommodating part 174 according to this embodiment includes a discharge valve seating surface 1741 and the discharge guide hole 1742. The discharge valve seating surface 1741 defines a bottom surface of the discharge valve accommodating part 174, and the discharge guide hole 1742 constitutes a part of a discharge passage opened or closed by a discharge valve. Accordingly, a refrigerant discharged from the discharge port 1511 moves to the intermediate discharge port 1612*a* of the back pressure plate 161 via the discharge valve accommodating part 174.

The discharge valve seating surface 1741 is disposed to be recessed in the second axial side surface 171*b* of the retainer block 171 (or the block body part) facing the back pressure chamber assembly 160 by a preset depth, e.g., by a height of the axial fixing protrusions 1722. Accordingly, the plurality of axial fixing protrusions 1722 spaced apart from each other at an edge of the second axial side surface 171*b* of the retainer block 171 (or the block body part) along a circumferential direction are connected to each other by the discharge valve seating surface 1741.

The discharge valve seating surface 1741 is disposed wider than the opening/closing surface 1751*a* of the discharge valve 1755 so that the discharge valve 1755 is seated thereon. The discharge valve seating surface 1741 is disposed flat such that the discharge guide hole 1742 to be described later is open and closed as the opening/closing surface 1751*a* of the discharge valve 1755 is brought into contact with or separated from the discharge valve seating surface 1741. Accordingly, when the discharge valve 1755 is closed, the opening/closing surface 1751*a* of the discharge valve 1755 is seated on the discharge valve seating surface 1741 to tightly close the discharge guide hole 1742 to be described later.

The discharge guide hole 1742 is disposed through the block fixing surface 1725 and the discharge valve seating surface 1741 in the axial direction. In other words, the discharge guide hole 1742 may be disposed through a portion between the block fixing surface 1725 defining the lower surface of the block body part 172 and the discharge valve seating surface 1741 defining the bottom surface of the discharge valve accommodating part 174. Accordingly, the discharge port 1511 can communicate with the discharge valve accommodating part 174 through the discharge guide hole 1742.

The discharge guide hole 1742 may be disposed on the same axial line as the discharge port 1511 or be disposed to at least partially communicate with the discharge port 1511 even though it is disposed on a different axial line from the discharge port 1511. In other words, an inner diameter of the discharge guide hole 1742 may be larger than or equal to an inner diameter of the discharge hole 1511 so that the discharge port 1511 is accommodated in the discharge guide hole 1742. Accordingly, refrigerant that has passed through the discharge port 1511 moves into the discharge valve accommodating part 174 through the discharge guide hole 1742.

The axial fixing protrusions 1722 described above may be disposed at an edge of the discharge valve seating surface 1741 to have a step portion with a preset height. For example, the first to fourth axial fixing protrusions 1722*a* to 1722*d* may be disposed at the edge of the discharge valve seating surface 1741 at an interval to have gaps therebetween along a circumferential direction, the gaps corresponding to the first to fourth discharge guide grooves 1723*a* to 1723*d*. Accordingly, the discharge valve seating surface 1741 may define substantial volume of the discharge valve accommodating part 174, together with the first to fourth axial fixing protrusions 1722*a* to 1722*d* to communicate with the intermediate discharge port 1612*a* of the back pressure plate 161 without obstruction through spaces between the first to fourth axial fixing protrusions 1722*a* to 1722*d*.

Although not shown in the drawing, an inner circumferential surface of the discharge valve accommodating part 174 may be disposed to have a step portion or to be inclined. For example, inner circumferential surfaces of the first to fourth axial fixing protrusions 1722*a* to 1722*d* constituting a side surface of the discharge valve seating surface 1741 may be disposed to have a step portion or to be inclined. In these cases, even when the discharge valve accommodating part 174 is configured to have a great depth, stagnation of refrigerant due to a vortex near the inner circumferential surfaces of the first to fourth axial fixing protrusions 1722*a* to 1722*d* constituting the inner circumferential surface of the discharge valve accommodating part 174 may be resolved. Accordingly, a thickness of the discharge valve accommodating part 174, e.g., a length of the discharge guide hole 1742 may be configured to be small by configuring the discharge valve accommodating part 174 to have a great depth, thereby reducing dead volume in the discharge port 1511.

Referring back to FIGS. 2 to 4, the valve member 175 according to this embodiment includes the bypass valve 1751 and the discharge valve 1755. A reed valve may be applied to the bypass valve 1751, and a piston valve may be applied to the discharge valve 1755. However, the present disclosure is not limited thereto. In other words, the bypass valve 1751 may be a piston valve, and the discharge valve 1755 may be a reed valve. However, in this embodiment, as described above, an example in which a reed valve is applied to the bypass valve 1751 and a piston valve is applied to the discharge valve 1755 is mainly described.

Referring to FIGS. 8 to 12, the bypass valve 1751 includes the first bypass valve 1752, the second bypass valve 1753, and the valve connection portion 1754. In other words, the first bypass valve 1752 configured to open or close the first bypass hole 1512*a* and the second bypass valve 1753 configured to open or close the second bypass hole 1512*b* may be connected to each other by the valve connection portion 1754. In this case, the bypass valve 1751 may be easily assembled and assembly reliability may be increased. That is, even when the first bypass valve 1752 and the second bypass valve 1753 are respectively fastened with one valve fastening member, a same effect as that of performing fastening with two valve fastening members may be ultimately obtained. Accordingly, when the bypass valve 1751 is provided in plurality, since alignment position of the plurality of bypass valves 1751 are prevented from being misaligned, the plurality of bypass valves 1751 may be easily and tightly assembled.

However, the valve connection portion 1754 is not necessarily needed. For example, the first bypass valve 1752 and the second bypass valve 1753 may be separate from each other and included independently. In this case, the bypass valves 1751 may be easily manufactured and a material loss may be reduced. That is, since the valve connection portion 1754 is not included, the first bypass valve 1752 and the second bypass valve 1753 may be manufactured symmetrically to each other. Thus, the bypass valves 1751 may be easily manufactured, and a portion to be removed from a base material due to shape machining of the valve connection portion 1754 is not generated. Accordingly, a material cost may be correspondingly reduced. Hereinafter, an example in which the first bypass valve 1752 and the second bypass valve 1753 are connected to each other is described. An example in which the first bypass valve 1752 and the second bypass valve 1753 are separate from each other and included independently will be described later with reference to another embodiment.

Referring to FIGS. 10 to 12, the first bypass valve 1752 is disposed in parallel with the second bypass valve 1753. However, as described above, the first bypass valve 1752 and the second bypass valve 1753 may be disposed to be inclined at a present angle, i.e., at an angle of approximately 45° with respect to the first center line CL1 connecting the center Od of the discharge port 1511 to the center Ob1 of the first bypass hole 1512*a* and the center Ob2 of the second bypass hole 1512*b* located at both sides of the center Od instead of being perpendicular to the first center line CL1. Accordingly, the first opening/closing portion 1752*b* and the second opening/closing portion 1753*b*, which will be described later, may be located on the first center line CL1 at both sides of the discharge port 1511, and the first fixing portion 1752*a* and the second fixing portion 1752*a*, which will be described later, may be located at both sides of the discharge port 1511 to be perpendicular to the first center line CL1. In addition, the valve connection portion 1754 may be disposed to surround the discharge port 1511 to be perpendicular to the first center line CL1. Accordingly, the first bypass valve 1752 and the second bypass valve 1753 may be located far away from the first bypass hole 1512*a* and the second bypass hole 1512*b* as possible without interfering with the discharge port 1511 to thereby suppress overcompression and/or collision noise.

In detail, the first bypass valve 1752 includes the first fixing portion 1752*a* and the first opening/closing portion 1752*b*. The first fixing portion 1752*a* is a portion constituting a fixed end of the first bypass valve 1752, and the first opening/closing portion 1752*b* is a portion constituting a free end of the first fixing portion 1752*a*. Accordingly, the first bypass valve 1752 constitutes a cantilever having a rectangular shape.

The first bypass valve 1752 includes a first elastic portion (no reference numeral) having a long and narrow shape between the first fixing portion 1752*a* and the first opening/closing portion 1752*b*. However, since the first elastic portion together with the first opening/closing portion 1752*b* rotates around the first fixing portion 1752*a*, it may be understood that the first elastic portion is included in the first opening/closing portion 1752*b*, hereinafter. This is also applied to the second bypass valve 1753.

The first fixing portion 1752*a* is fixed in close contact between the retainer block 171 and the non-orbiting end plate portion 151. In other words, both side surfaces of the first fixing portion 1752*a* are fixed in close contact with the first valve fixing surface 1731*a* of the retainer block 171 and the block seating surface 1551 of the non-orbiting end plate portion 151, respectively. Accordingly, the retainer block 171 is fixed in close contact with the block insertion groove 155.

The first fixing portion 1752*a* includes a first valve through-hole 1752*c* through which the first valve fastening member (first rivet) 1771 is inserted. An inner diameter of the first valve through-hole 1752*c* is smaller than an outer diameter of the head 1771*a* of the first valve fastening member 1771. Accordingly, the first fixing portion 1752*a* is firmly fixed to the first valve fixing surface 1731*a* defining the first axial side surface 171*a* of the retainer block 171, by the head 1771*a* of the first valve fastening member 1771 which is inserted therethrough from the non-orbiting scroll 150 toward the retainer block 171.

The first opening/closing portion 1752*b* extends from the first fixing portion 1752*a* to be bendable between the retainer block 171 and the non-orbiting end plate portion 151. In other words, one end of the first opening/closing portion 1752*b* extends from the first fixing portion 1752*a* and the other end is configured as a free end to form a cantilever. Accordingly, the first opening/closing portion 1752*b* is flexibly bent based on the first fixing portion 1752*a* in a space defined between the first valve opening/closing surface 1731*b* of the retainer block 171 and the block seating surface 1551 of the non-orbiting end plate portion 151 facing the first valve opening/closing surface 1731*b*.

A cross-sectional area of the first opening/closing portion 1752*b* is wider than that of the first bypass hole 1512*a*. Accordingly, the first opening/closing portion 1752*b* opens and closes the first bypass hole 1512*a* while being flexibly bent based on the first fixing portion 1752*a* by pressure of the compression chamber V.

Referring to FIGS. 10 to 12, the second bypass valve 1753 includes a second fixing portion 1753*a* and a second opening/closing portion 1753*b*. The second fixing portion 1753*a* is a portion forming a fixed end of the second bypass valve 1753 and corresponds to the first fixing portion 1752*a*, and the second opening/closing portion 1753*b* is a portion forming a free end of the second fixing portion 1753*a* and corresponds to the first opening/closing portion 1752*b*. Therefore, a description of the second bypass valve 1753 will be understood by the description of the first bypass valve 1752.

For example, the second fixing portion 1753*a* includes a second valve through-hole 1753*c*, and a cross-sectional area of the second opening/closing part 1753*b* is wider than that of the second bypass hole 1512*b*. Accordingly, the first fixing portion 1752*a* is fixed to the second valve fixing surface 1732*a* of the retainer block 171 by the head 1772*a* of the second valve fastening member 1772, and the second opening/closing portion 1753*b* opens and closes the second bypass hole 1512*b* by being bent based on the second fixing portion 1753*a*.

However, the second fixing portion 1753*a* is disposed on the second center line CL2 at a side opposite to the first fixing portion 1752*a* with reference to the discharge port 1511, and the second opening/closing portion 1753*b* is disposed on the first center line CL1 at a side opposite to the first opening/closing portion 1752*b* with reference to the discharge port 1511. In other words, the bypass valves 1751 are disposed along a circumferential direction in an order from the first fixing portion 1752*a*, the first opening/closing portion 1752*b*, the second fixing portion 1753*a* to the second opening/closing portion 1753*b*. Accordingly, the first bypass valve 1752 including the first fixing portion 1752*a* and the first opening/closing portion 1752*b*, and the second bypass valve 1753 including the second fixing portion 1753*a* and the second opening/closing portion 1753*b* may be configured to have an approximately square (or diamond) shape when projected in an axial direction. By doing so, as described above, the block insertion groove 155 may be configured in a circular shape, and the first opening/closing portions 1752*b* and the second opening/closing portions 1753*b* may be configured to have a great length as possible to suppress a delay in opening the bypass valves 1751.

Referring to FIGS. 8 to 10, the valve connection portion 1754 is a portion connecting between the first bypass valve 1752 and the second bypass valve 1753, in detail, connecting between the first fixing portion 1752*a* and the second fixing portion 1753*a*. The valve connection portion 1754 extends from the first bypass valve 1752 and the second bypass valve 1753 as a single body. Accordingly, the bypass valves 1751 may be easily assembled, and the first bypass valve 1752 and the second bypass valve 1753 may be fastened by one fastening member 1771 and one fastening member 1772, respectively, but an effect of fastening the first bypass valve 1752 and the second bypass valve 1753 respectively using two fastening members of 1771 and 1772 may be obtained. By doing so, when the bypass valves 1751 are fastened, misalignment due to distortion of the bypass valves 1751 can be suppressed.

In detail, the valve connection portion 1754 may include first valve connection portions 1754*a* and a second valve connection portion 1754*b*. The first valve connection portions 1754*a* are portions extending from the first fixing portion 1752*a* and the second fixing portion 1753*a*, respectively. The second connection portion 1754*b* is a portion connecting between the first connection parts 1754*a*. Accordingly, the first valve connection portions 1754*a* may be disposed in plurality, and the second valve connection portion 1754*b* may be disposed in singularity.

The first connection portions 1754*a* may be disposed in a linear shape, and the second connection portion 1754*b* may be disposed in a circular shape. In other words, the first connection portions 1754*a* may be each disposed in a straight line along the second center line CL2, and the second connection portion 1754*b* may be disposed to connect ends of both the first connection portions 1754*a* in a circular shape. In other words, the first connection portions 1754*a* may be connected to each other by the second connection portion 1754*b* surrounding the discharge guide hole 1742 of the block body part 172 so that the valve connection portion 1754 is configured as a single body. Accordingly, even when the discharge guide hole 1742 is located between the first fixing portion 1752*a* and the second fixing portion 1753*a*, the discharge guide hole 1742 may not be covered by the valve connection portion 1754, and connection may be performed between the first fixing portion 1752*a* and the second fixing portion 1753*a*.

In other words, a discharge communication hole 1754*c* may disposed in the second connection portion 1754*b* to communicate with the discharge guide hole 1742. The discharge communication hole 1754*c* is configured to have an inner diameter equal to or greater than that of the discharge guide hole 1742. Accordingly, since the second connection portion 1754*b* does not interfere with the discharge guide hole 1742, refrigerant passing through the discharge guide hole 1742 may not be blocked by the second connection portion 1754*b* but smoothly move toward the discharge valve accommodating part 174.

Although not shown in the drawing, the first bypass valve 1752 and the second bypass valve 1753 may be separate from each other and assembled independently. In other words, the first bypass valve 1752 may include the first fixing portion 1752*a* and the first opening/closing portion 1752*b*, and the second bypass valve 1753 may include the second fixing portion 1753*a* and the second opening/closing portion 1753*b*, and the first fixing portions 1752*a* of the first bypass valve 1752 and the second fixing portion 1753*a* of the second bypass valve 1753 may be separate from each other. Accordingly, when the first bypass valve 1752 and the second bypass valve 1753 are disposed independently, the first bypass valve 1752 and the second bypass valve 1753 may be easily manufactured. In addition, since the valve connection portion 1754*c* is not disposed between the first bypass valve 1752 and the second bypass valve 1753, a material loss may be reduced compared to the above-described embodiment.

Meanwhile, the discharge valve 1755 is slidably inserted in the axial direction into the valve guide groove 1612*b* provided in the back pressure plate 161 to open and close the discharge guide hole 1742 described above. The discharge valve 1755 is always or periodically accommodated in the discharge valve accommodating part 174. For example, when the discharge valve 1755 is configured to be longer than a depth of the discharge valve accommodating part 174, the opening/closing surface 1751*a* of the discharge valve 1755 may be located inside the discharge valve accommodating part 174 not only when the discharge valve 1755 is closed but also when the discharge valve 1755 is open. On the other hand, when the discharge valve 1755 is configured to be shorter than the depth of the discharge valve accommodating part 174, the opening/closing surface 1751*a* of the discharge valve 1755 may be located outside the discharge valve accommodating part 174 when the discharge valve 1755 is open. In the former case, the discharge valve 1755 can be quickly closed, whereas in the latter case, discharge resistance due to the discharge valve 1755 can be reduced.

The discharge valve 1755 may be configured in a shape of a rod or cylinder. In other words, the discharge valve 1755 may be configured in a solid cylindrical shape or a hollow cylindrical shape. The discharge valve 1755 of this embodiment may be configured in a semi-circular rod or semi-cylindrical shape with an upper end closed and a lower end open. This can reduce a weight of the discharge valve 1755 and simultaneously prevent oil in the high-pressure part 110*b*, which is a discharge space, from accumulating inside the discharge valve 1755.

Although not illustrated, the discharge valve 1755 may alternatively be configured in a semi-circular rod or semi-cylindrical shape with an upper end open and a lower end closed. In this case, the weight of the discharge valve 1755 can be reduced, and the opening/closing surface of the discharge valve 1755 can be close to the discharge port 1511, thereby decreasing a dead volume. However, in this case, an oil discharge hole (not illustrated) may be disposed near the opening/closing surface 1751*a* of the discharge valve 1755 to penetrate through between inner and outer circumferential surfaces of the discharge valve, thereby preventing stagnation of oil in the discharge valve 1755.

Meanwhile, the retainer block 171 according to this embodiment may be pressed between the non-orbiting scroll 150 and the back pressure chamber assembly 160 in an axial direction to be fixed to the non-orbiting scroll 150. For example, the retainer block 171 may be pressed between the non-orbiting scroll 150 and the back pressure chamber assembly 160 by the gasket 180 or a separate elastic member (not shown) to be fixed to the non-orbiting scroll 150. In this embodiment, an example in which the retainer block 171 is pressed and fixed by the gasket 180 is shown.

Figure 13:
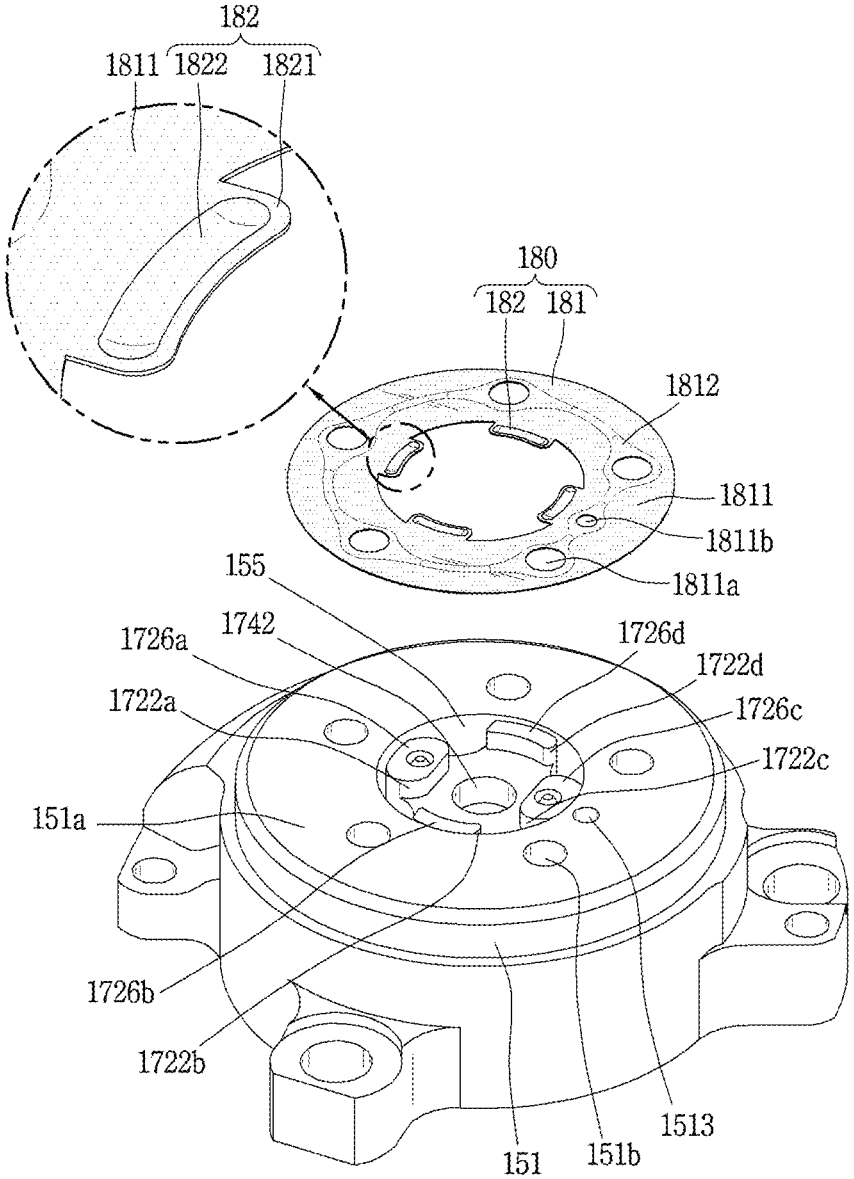
FIG. 13 is an exploded perspective view illustrating a gasket of FIG. 3.
Figure 14:
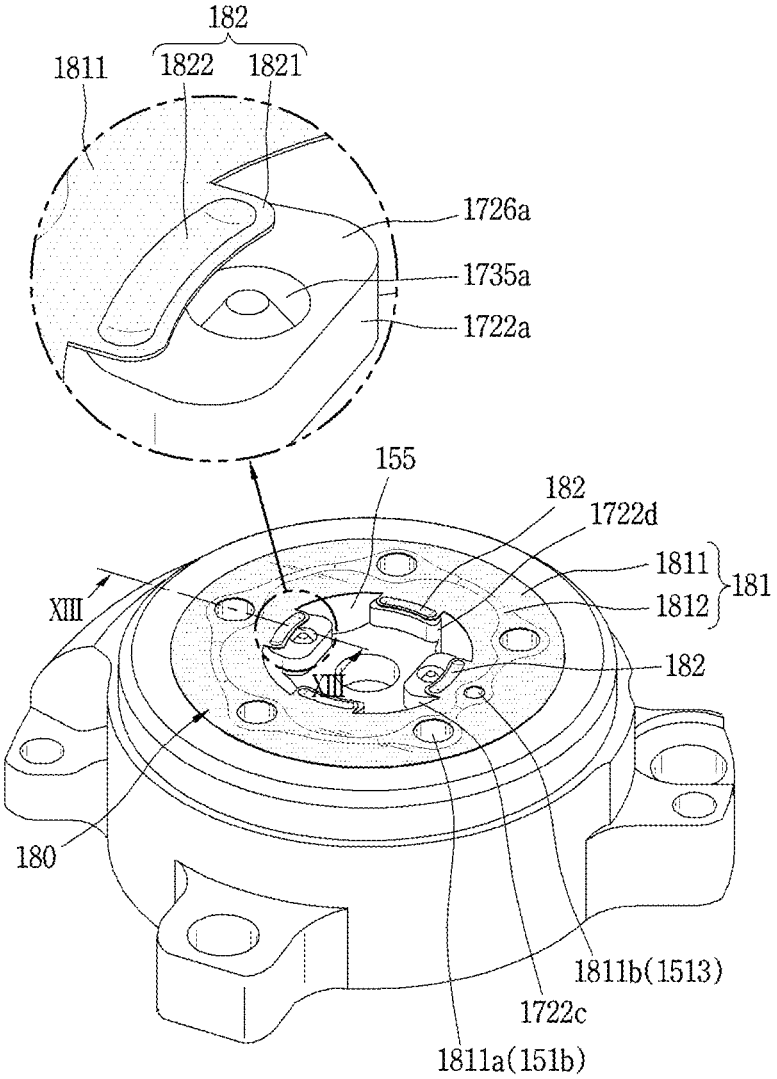
FIG. 14 is an assembled planar view of the gasket of FIG. 13.
Figure 15:
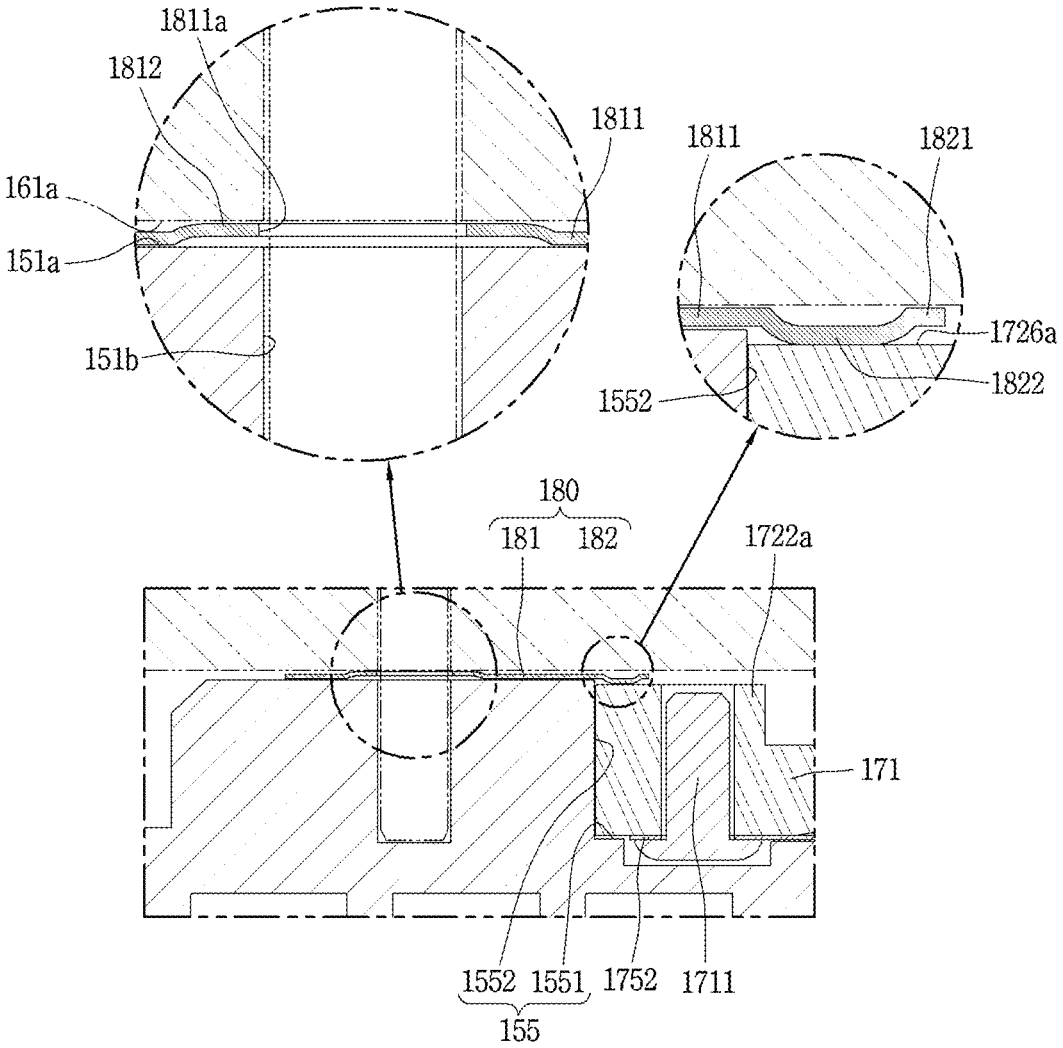
FIG. 15 is a sectional view taken along line "XIII-XIII" of FIG. 14.

Referring to FIGS. 13 to 15, the gasket 180 is a member configured to seal between the non-orbiting scroll 150 and the back pressure chamber assembly 160. In this embodiment, a part of the gasket 180 may be extended to fix the retainer block 171 in an axial direction. Accordingly, the gasket 180 or the part of the gasket 180 may be understood as a block support member.

Generally, the gasket 180 may be made of a single material, such as a non-metal material or a metal material, or may be obtained by applying a non-metal material to a surface of a metal material. In this embodiment, the retainer block 171 is fixed using elastic force of the gasket 180. Thus, it may be advantageous to use a metal material or apply a non-metal material to a surface of a metal material to secure elastic force. Accordingly, the retainer block 171 may be stably fixed to the non-orbiting scroll 150 without having to include a separate fixing member, thereby reducing a manufacturing cost and simplifying a manufacture process.

In detail, the gasket 180 according to this embodiment may include a sealing portion 181 and a block support portion 182. The sealing portion 181 is a portion configured to seal between the non-orbiting scroll 150 and the back pressure seal assembly 160. The block support portion 182 is a portion configured to press the retainer block 171 toward the non-orbiting scroll 150 to support the retainer block 171 in an axial direction. The sealing portion 181 and the block support portion 182 may be constituted as a single body, or constituted by performing post-assembling. In this embodiment, an example in which the sealing portion 181 and the block support portion 182 are disposed to extend as a single body is shown. Accordingly, the gasket 180 configured to perform sealing between the non-orbiting scroll 150 and the back pressure chamber assembly 160 and, simultaneously, fix the retainer block 171 to the non-orbiting scroll 150 may be easily configured.

The sealing portion 181 may include a sealing surface potion 1811 and a sealing bead 1812. The sealing surface portion 1811 is a portion disposed to be approximately in surface contact between the non-orbiting scroll 150 and the back pressure chamber assembly 160 to constitute a main body of the gasket 180. The sealing bead 1812 is a portion configured to surround back pressure through holes 1811*a* and a back pressure connection hole 1811*b*, which will be described later, to substantially seal the back pressure through holes 1811*a* and the back pressure connection hole 1811*b*.

Referring to FIGS. 13 and 14, the sealing surface portion 1811 may be configured in an annular shape having a same thickness and width along a circumferential direction. For example, an outer diameter of the sealing surface portion 1811 may be configured to be smaller than or equal to that of the non-orbiting end plate portion 151 and/or that of the back pressure plate 161. In other words, an outer diameter of the sealing surface portion 1811 may be greater than a diameter of a virtual circle connecting the plurality of back pressure fastening grooves 151*b* in the rear surface 151*a* of the non-orbiting end plate portion 151 disposed along a circumferential direction. Accordingly, the sealing surface portion 1811 may be concealed between the non-orbiting scroll 150 and the back pressure chamber assembly 160 not to be exposed to outside, and tightly seal a space between the non-orbiting scroll 150 and the back pressure chamber assembly 160.

In addition, an inner diameter of the sealing surface portion 1811, i.e., an inner diameter D4 of the sealing surface portion 181 may be configured to be equal to or larger than an inner diameter of the block insertion groove 155, i.e., the inner diameter D31 of the block accommodating surface 1552. In other words, the inner diameter D4 of the sealing surface portion 1811 may be configured to equal to or greater than an inner diameter of the block insertion groove 155, i.e., the inner diameter D31 of the block accommodating surface 1552 so that the inner circumferential surface of the sealing surface portion 1811 does not protrude toward an axial center O further than the inner circumferential surface of the block insertion groove 155. Accordingly, refrigerant discharged through the bypass holes 1512 may move smoothly to the intermediate discharge port 1612*a* without being blocked by the sealing surface portion 1811 of the gasket 180.

A plurality of the back pressure through holes 1811*a* may be disposed in the sealing surface portion 1811 at a preset interval along a circumferential direction. For example, the back pressure through holes 1811*a* may be disposed between the back pressure fastening grooves 151*b* and the back pressure fastening holes 1611*a* described above to be located on a same axis as that of the back pressure fastening grooves 151*b* and the back pressure fastening hole 1611*a*. Accordingly, the back pressure fastening bolts 177 may penetrate through the sealing surface portion 1811 of the gasket 180 to firmly fasten the non-orbiting scroll 150 with the back pressure chamber assembly 160.

In addition, one back pressure connection hole 1811*b* may be disposed in the sealing surface portion 1811. The one back pressure connection hole 1811*b* may be disposed between the first back pressure hole 1513 and the second back pressure hole 1611*b*, each described above, to be located on a same axis as that of the first back pressure hole 1513 and the second back pressure hole 1611*b*. Accordingly, refrigerant that has passed through the first back pressure hole 1513 moves to the back pressure chamber 160*a* through the one back pressure connection hole 1811*b* and the second back pressure hole 1611*b*.

Referring to FIGS. 14 and 15, the sealing bead 1812 may be disposed to axially protrude from the sealing surface portion 1811 toward the rear surface 151*a* of the non-orbiting end plate portion 151 and/or the rear surface 161*a* of the back pressure plate 161 facing the rear surface 151*a*. For example, the sealing bead 1812 may be disposed to surround peripheries of the back pressure through holes 1811*a* and the back pressure connection hole 1811*b*, and protrude from the sealing surface portion 1811 toward the rear surface 161*a* of the back pressure plate 161. Accordingly, when the non-orbiting end plate portion 151 is fastened with the back pressure plate 161, the sealing bead 1812 may be pressed against the rear surface 161*a* of the back pressure plate 161 to tightly seal the back pressure through holes 1811*a* and the back pressure connection hole 1811*b*.

Referring to FIGS. 13 to 15, the block support portion 182 may radially extend from an inner circumferential surface of the sealing portion 181 toward the axial center O. For example, the block support portion 182 may be configured in an annular shape or an arc shape. However, when the block support portion 182 is configured in an annular shape, the block support portion 182 may protrude in a radial direction further than an inner circumferential surface of the block insertion groove 155 to block a space between the axial fixing protrusions 1722 of the block body part 172, i.e., the discharge guide grooves 1723. Then, the block support portion 182 defines a kind of flow barrier between the discharge guide grooves 1723 and the intermediate discharge port 1612*a*, thus preventing refrigerant discharged from the bypass holes 1512 from smoothly moving to the intermediate discharge port 1612*a*. Accordingly, in this embodiment, an example in which the block support portion 182 is configured in an arc shape, precisely, in a shape and/or position that does not interfere with the discharge guide grooves 1723.

In detail, the block support portion 182 according to this embodiment may include a plurality of extension protrusions 1821 and a plurality of support protrusions 1822. Each of the extension protrusions 1821 is a portion constituting a main body of the block support portion 182, and each of the support protrusions 1822 is a portion configured to support the retainer block 171 in an axial direction. Hereinafter, one extension protrusion among the plurality of extension protrusions 1821 and one support protrusion among the plurality of support protrusions 1822 are described as representative examples, respectively.

Referring to FIGS. 14 to 15, an extension protrusion 1821 may be configured as a single body on an inner circumferential surface of the sealing surface portion 1811 and radially extend toward the axial center O (or a center of the discharge port). For example, the extension protrusion 1821 may be configured in an arc shape as described above, and disposed to overlap the block support surfaces 1726*a* to 1726*d* of the axial fixing protrusions 1722 in an axial direction. Accordingly, the block body part 172 of the retainer block 171 may be supported in a second axis direction toward the back pressure chamber assembly 160 by an extension protrusion 1821 of the block support portion 182.

The extension protrusion 1821 may be configured to be smaller than or equal to a sectional area of each of the block support surfaces 1726*a* to 1726*d* of the axial fixing protrusions 1722. In other words, the extension protrusion 1821 may be disposed to be located within a range of each of the block support surfaces 1726*a* to 1726*d* of the axial fixing protrusion 1722. Accordingly, the discharge guide grooves 1723 may be prevented from being covered by the extension protrusion 1821.

Meanwhile, referring to FIG. 14, a support protrusion 1822 may protrude from a middle position of the extension protrusion 1821 in an axial direction by a preset height. Accordingly, the block body part 172 of the retainer block 171 inserted into the block insertion groove 155 may be pressed toward the block seating surface 1551 by the support protrusion 1822 of the gasket 180 constituting a block support member to be tightly fixed in an axial direction. Thus, a height of the block body part 172 may be compensated for in correspondence with an axial height of the support protrusion 1822.

Accordingly, even when a height of the block body part 172, i.e., the height H2 of the block support surface is configured to be slightly less than the depth D1 of the block insertion groove 155, the block body part 172 may be tightly fixed toward the block seating surface 1551.

In addition, the support protrusion 1822 may protrude toward the retainer block 171 or toward the back pressure chamber assembly 160. In this embodiment, an example in which the support protrusion 1822 protrudes toward the second axial side surface 171*b* of the retainer block 171, i.e., the block fixing surface 1725 of the axial fixing protrusions 1722. In other words, in this embodiment, an example in which the support protrusion 1822 protrudes in an direction opposite to the sealing bead 1812 described above is shown. Accordingly, even when an axial height of the support protrusion 1822 is not configured to be excessively high, a substantial height of the support protrusion 1822 may be increased to tightly fix the block body part 172 toward the block seating surface 1551.

In addition, the support protrusion 1822 may be disposed in an embossed shape recessed from one side surface to another side surface of the extension protrusion 1821 as shown in FIG. 15. Thus, elastic force of the support protrusion 1822 may be improved to allow to actively deal with a machining error between the block insertion groove 155 and the retainer block 171. However, the support protrusion 1822 is not limited to the embossed shape. For example, the extension protrusion 1821 may be disposed flatly, and the support protrusion 1822 may be disposed to protrude from a side surface of the extension protrusion 1821 facing the retainer block 171. In this case, physical support force of the support protrusion 1822 may be improved.

In addition, the support protrusion 1822 may be configured in an arc shape to have a length in a circumferential direction as shown in FIG. 14. Accordingly, an area of the support protrusion 1822 may be increased to thereby stably support the retainer block 171. However, the support protrusion 1822 is not limited to the arc shape. For example, the support protrusion 1822 may be configured in a circular sectional shape, and a plurality of support protrusions 1822 may be disposed at a preset interval along a circumferential direction. In this case, the support protrusions 1822 may be easily disposed.

In the drawings, an unexplained reference numeral 1756 denotes an elastic member supporting the discharge valve.

The scroll compressor according to the embodiment of the present disclosure may operate as follows.

That is, when power is applied to the drive motor 120 and rotational force is generated, the orbiting scroll 140 eccentrically coupled to the rotational shaft 125 performs an orbiting motion relative to the non-orbiting scroll 150 by an Oldham ring 139. During this process, a first compression chamber V1 and a second compression chamber V2 that continuously move are disposed between the orbiting scroll 140 and the non-orbiting scroll 150. Then, the first compression chamber V1 and the second compression chamber V2 are gradually reduced in volume as moving from the suction port (or suction chamber) 1531 to the discharge port (or discharge chamber) 1511 during the orbiting motion of the orbiting scroll 140.

Accordingly, refrigerant is suctioned into the low-pressure part 110*a* of the casing 110 through the refrigerant suction pipe 117. Some of this refrigerant are suctioned directly into the suction pressure chambers (no reference numerals given) of the first compression chamber V1 and the second compression chamber V2, respectively, while the remaining refrigerant first flows toward the drive motor 120 to cool down the drive motor 120 and then is suctioned into the suction pressure chambers (no reference numerals given).

Then, the refrigerant is compressed while moving along moving paths of the first compression chamber V1 and the second compression chamber V2. The compressed refrigerant partially flows into the back pressure chamber 160*a* defined by the back pressure plate 161 and the floating plate 165 through the first back pressure hole 1513 and the second back pressure hole 1611*b* before reaching the discharge port 1511. Accordingly, the back pressure chamber 160*a* forms intermediate pressure.

Then, the floating plate 165 then rises toward the high/low pressure separation plate 115 to be brought into close contact with the sealing plate 1151 provided on the high/low pressure separation plate 115. Then, the high-pressure part 110*b* of the casing 110 is separated from the low-pressure part 110*a*, to prevent the refrigerant discharged from each compression chamber V1 and V2 to the high-pressure part 110*b* from flowing back into the low-pressure part 110*a*.

On the other hand, the back pressure plate 161 is pressed down toward the non-orbiting scroll 150 by pressure of the back pressure chamber 160*a*. Then, the non-orbiting scroll 150 is pressed toward the orbiting scroll 140. Accordingly, the non-orbiting scroll 150 can be brought into close contact with the orbiting scroll 140, thereby preventing the refrigerant inside the both compression chambers from leaking from a high-pressure compression chamber forming an intermediate pressure chamber to a low-pressure compression chamber.

Then, the refrigerant is compressed to a set pressure while moving from the intermediate pressure chamber toward the discharge pressure chamber. This refrigerant moves to the discharge port 1511 and the discharge guide hole 1742 communicating with the discharge port 1511 to press the discharge valve 1755 in an opening direction. Responsive to this, the discharge valve 1755 is pushed up along the valve guide groove 1612*b* by pressure of the discharge pressure chamber, so as to open the discharge port 1511 and the discharge guide hole 1742. Then, the refrigerant in the discharge pressure chamber exhausts to the discharge valve accommodating part 174 through the discharge port 1511 and the discharge guide hole 1742, and then flows toward the high-pressure part through the intermediate discharge port 1612*a* provided in the back pressure plate 161.

Meanwhile, pressure of refrigerant may rise above a preset pressure due to various conditions occurring during operation of the compressor. Then, the refrigerant moving from the intermediate pressure chamber to the discharge pressure chamber is partially bypassed in advance from the intermediate pressure chamber forming each compression chamber V1 and V2 toward the high-pressure part 110*b* through the first bypass hole 1512*a* and the second bypass hole 1512*b* before reaching the discharge pressure chamber.

When pressure in the first compression chamber V1 and pressure in the second compression chamber V2 are higher than a set pressure, the refrigerant compressed in the first compression chamber V1 moves to the first bypass hole 1512*a*, and the refrigerant in the second compression chamber V2 moves to the second bypass hole 1512*b*. Then, the refrigerants moving to these bypass holes 1512*a* and 1512*b* push up the first opening/closing portion 1752*b* of the first bypass valve 1752 and the second opening/closing portion 1753*b* of the second bypass valve 1753 that close the first bypass hole 1512*a* and the second bypass hole 1512*b*. Then, the first opening/closing portion 1752*b* is bent based on the first fixing portion 1752*a* and the second opening/closing portion 1753*b* is bent based on the second fixing portion 1753*a* to open the first bypass hole 1512*a* and the second bypass hole 1512*b*. At this time, an open degree of the first opening/closing portion 1752*b* is limited by the first valve opening/closing surface 1731*b* of the retainer block 171, and an open degree of the second opening/closing portion 1753*b* is limited by the second valve opening/closing surface 1732*b* of the retainer block 171.

Then, the refrigerant in the first compression chamber V1 and the refrigerant in the second compression chamber V2 exhaust through the first bypass hole 1512*a* and the second bypass hole 1512*b*, respectively, to the block insertion groove 155. These refrigerants move toward the discharge valve accommodating part 174 through the discharge guide passage 170*a* that is a space between the retainer block 171 and the block insertion groove 155. The refrigerants flow to the high-pressure part 110*b* through the intermediate discharge port 1612*a* of the back pressure plate 161 together with the refrigerant discharged to the discharge valve accommodating part 174 through the discharge guide hole 1742. Accordingly, the refrigerant compressed in the compression chamber V can be suppressed from being overcompressed to a set pressure or higher, thereby suppressing damage to the orbiting wrap 142 and/or the non-orbiting wrap 152 and improving compressor efficiency.

Then, when the overcompression of the compression chamber V is resolved and an appropriate pressure is restored, the first opening/closing portion 1752*b* of the first bypass valve 1752 may rotate around the first fixing portion 1752*a* to be unbent, and the second opening/closing portion 1753*b* of the second bypass valve 1753 may rotate around the second fixing portion 1753*a* to be unbent. Then, a series of processes in which the first opening/closing portion 1752*b* blocks the first bypass hole 1512*a*, and the second opening/closing portion 1753*b* blocks the second bypass hole 1512*b* is repeatedly performed.

At this time, high-pressure refrigerant that has not yet been discharged is trapped in the first bypass hole 1512*a* and the second bypass hole 1512*b*. Then, as the pressure in the compression chamber V rises unnecessarily, the first bypass hole 1512*a* and the second bypass hole 1512*b* form a kind of dead volume. Therefore, it is advantageous in view of decreasing the dead volume to reduce the lengths of the first bypass hole 1512*a* and the second bypass hole 1512*a* by forming the non-orbiting end plate portion 151 having the first bypass hole 1512*a* and the second bypass hole 1512*b* to be as thin as possible.

However, in the case where the bypass valves 1751 are fastened to the non-orbiting end plate portion 151 as in the related art, the minimum fastening thickness for fastening the bypass valves 1751 is required, and this has a limitation in reducing the thickness of the non-orbiting end plate portion 151. As described above, in this embodiment, the bypass valves 1751 are fastened to the valve assembly 170 that is disposed between the rear surface 151*a* of the non-orbiting end plate portion 151 and the rear surface 161*a* of the back pressure plate 161 facing the rear surface 151*a*. This can allow the non-orbiting end plate portion 151, in which the bypass holes 1512*a* and 1512*b* are disposed, to be configured as thin as possible. Accordingly, the dead volume in the first bypass hole 1512*a* and the second bypass hole 1512*b* can be minimized by minimizing the lengths L2 of the first bypass hole 1512*a* and the second bypass hole 1512*b*. Through this, an amount of refrigerant remaining in the first bypass hole 1512*a* and the second bypass hole 1512*b* can be minimized, thereby enhancing compression efficiency.

Additionally, in this embodiment, since the block insertion groove 155 into which the retainer block 171 is inserted is configured in a circular shape, the non-orbiting scroll 150 including the block insertion groove 155 may be easily machined.

In addition, in the embodiment, since the plurality of bypass valves 1751 are disposed to be inclined with respect to a virtual line connecting both the bypass holes 1512, the block insertion groove 155 may be configured in a circular shape, and a sufficient opening/closing area such that both the bypass holes 1512 may be smoothly opened/closed may be secured.

Hereinafter, a case in which another embodiment of a block support member is present is described.

That is, in the above-described embodiment, a block support member extends from a gasket, but in some cases, a block support member may be separated from a gasket and installed between a back pressure chamber assembly and a retainer block.

Figure 16:
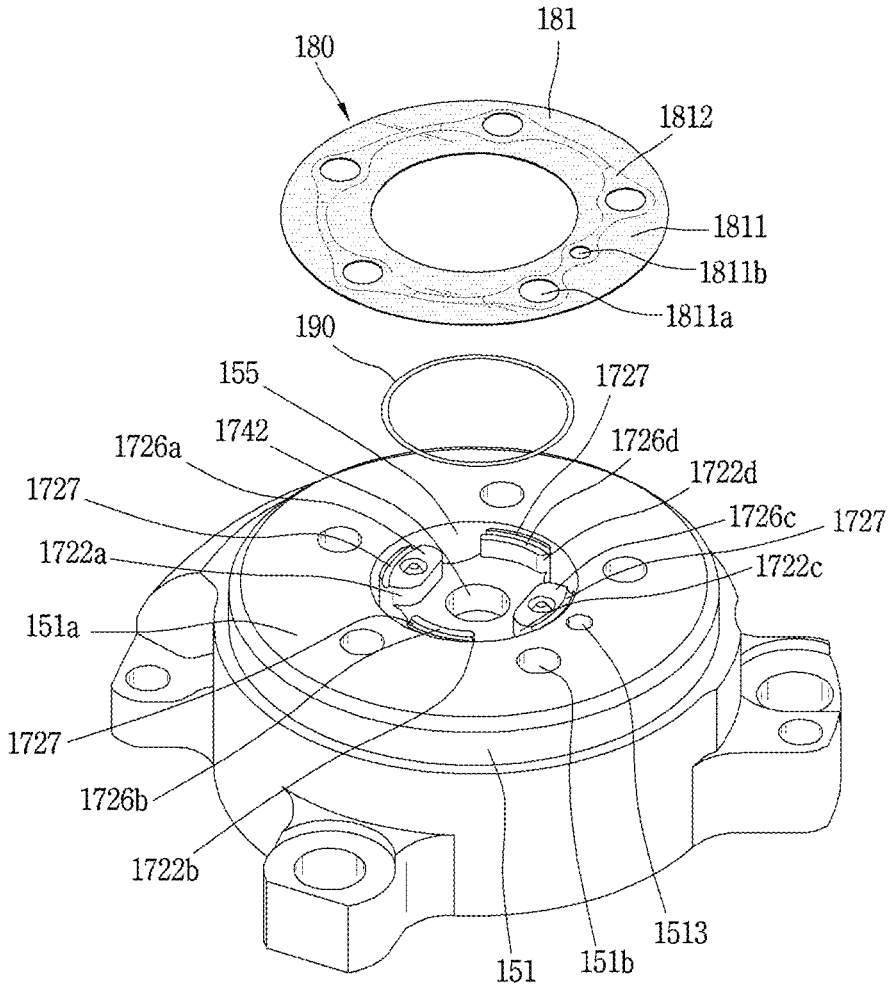
FIG. 16 is an assembled perspective view illustrating another embodiment of a block support member of FIG. 13.
Figure 17:
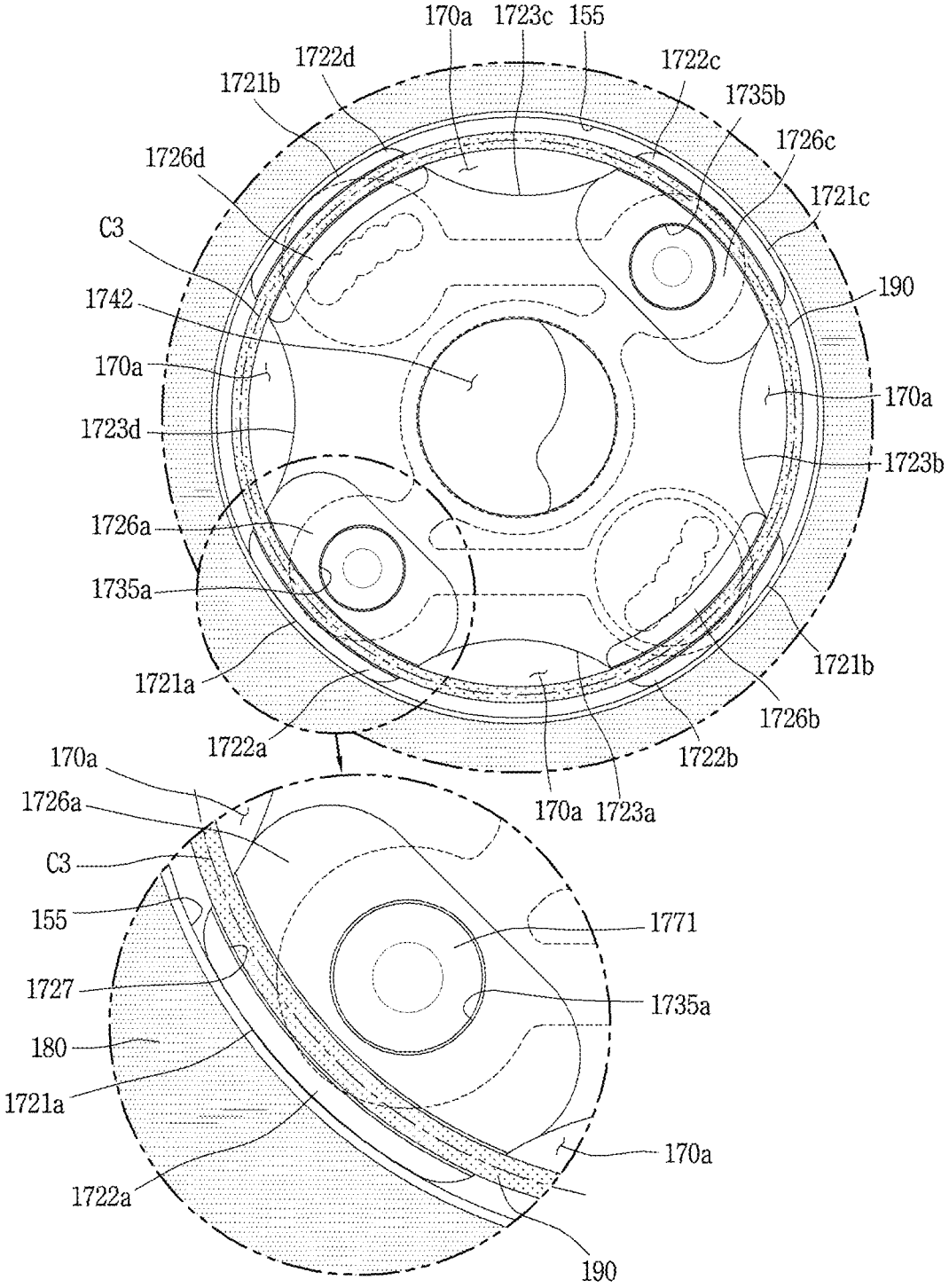
FIG. 17 is a planar view of FIG. 16.
Figure 18:
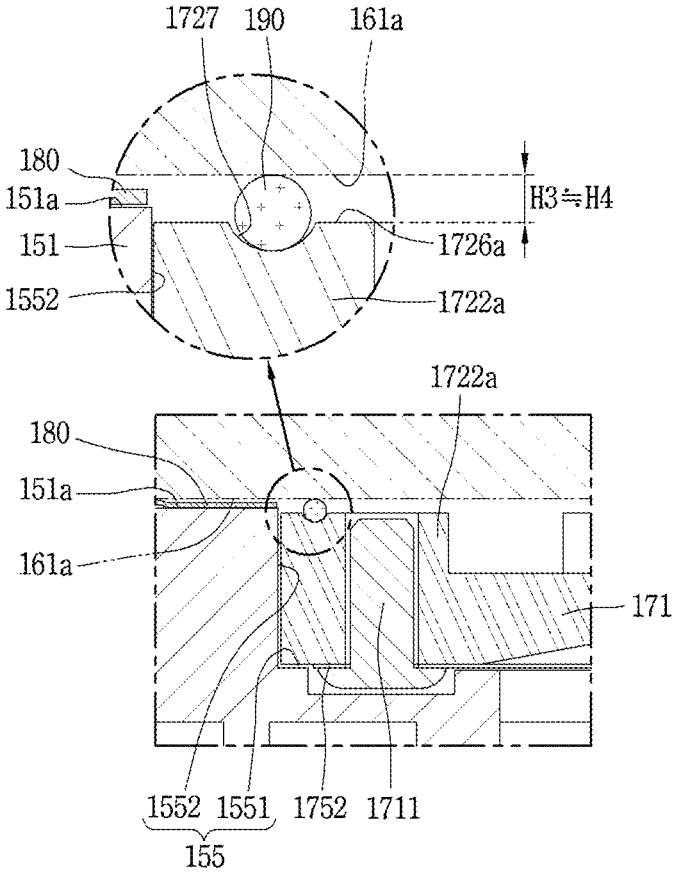
FIG. 18 is a sectional view taken along line "XIV-XIV" of FIG. 17.

Referring to FIGS. 16 to 18, the valve assembly 170 described above is disposed between the non-orbiting scroll 150 according to the embodiment and the back pressure chamber assembly 160. Since basic configurations and corresponding operational effects of the non-orbiting scroll 150, the back pressure chamber assembly 160, and the valve assembly 170 are similar to those in the above-described embodiment, and thus, will not be described here again.

In the above-described embodiment, the block support member extends radially from an inner circumferential surface of the gasket 180 toward the block insertion groove 155 to axially support an upper surface of the retainer block 171, i.e., the block support surfaces 1726*a* to 1726*d*. However, in this embodiment, a block support member 190 may be disposed separately from the gasket 180.

For example, the block support member 190 according to this embodiment may be made of an elastic member to be disposed between the rear surface 161*a* of the back pressure plate 161 and the block support surfaces 1726*a* to 1726*d* of the retainer block 171 facing the rear surface 161*a* in an axial direction. In this case, a support member insertion groove 1727 may be disposed in the rear surface 161*a* of the back pressure plate 161 and/or the block support surfaces 1726*a* to 1726*d* of the retainer block 171 such that the block support member 190 is inserted and fixed into the support member insertion groove 1727. In this embodiment, an example in which the support member insertion groove 1727 is disposed in each of the block support surfaces 1726*a* to 1726*d* is shown.

In detail, the block support member 190 according to this embodiment may be configured in an annular shape like an O-ring. The block support member 190 may be configured in a circular and/or angular sectional shape, and a height (or a diameter) of the block support member 190, precisely, a protrusion height H3 (a diameter) of the block support member 190 protruding from the support member insertion groove 1727 may be configured to be equal to or greater than a gap H4 between the rear surface 161*a* of the back pressure plate 161 and the block support surfaces 1726*a* to 1726*d* of the retainer block 171, as shown in FIG. 18. Accordingly, in a process of fastening the back pressure chamber assembly 160 to the non-orbiting scroll 150 by the back pressure fastening bolt 177, the block support member 190 may be pressed by fastening force of the back pressure fastening bolt 177 to press and support the retainer block toward the non-orbiting scroll.

The support member insertion groove 1727 may be configured variously according to a shape of the block support member 190. For example, when the block support member 190 is configured as an O-ring which is a circular elastic member as described above, the support member insertion groove 1727 may be also configured in an annular shape. However, when the support member insertion groove 1727 is disposed in the block support surfaces 1726*a* to 1726*d* of the retainer block 171, the block support surfaces 1726*a* to 1726*d* may be spaced apart from each other by a preset distance along a circumferential direction. Thus, the support member insertion groove 1727 in each of the block support surfaces 1726*a* to 1726*d* may be configured in an arc shape.

In this case, the support member insertion groove 1727 in each of the block support surfaces 1726*a* to 1726*d* may be located on a third virtual circle C3 when projected axially, as shown in FIG. 17. For example, the support member insertion groove 1727 in each of the block support surfaces 1726*a* to 1726*d* may be configured in an arc shape, and disposed across both circumferential ends of the block support surfaces 1726*a* to 1726*d*. Accordingly, the block support member 190 configured in a circular shape (a circle type) may be maintained in an original form.

In addition, the support member insertion groove 1727 may be configured to be smaller than a diameter of the block support member 190. Accordingly, as described above, since at least a part of the block support member 190 protrudes from the support member insertion groove 1727 to cause the block support member 190 to be pressed by fastening force of the back pressure fastening bolt 177, the retainer block 171 is pressed toward the non-orbiting scroll 150 to be supported in an axial direction.

As described above, when the block support member 190 is separate from the gasket 180 and disposed independently, there is no need to additionally configure a separate block support portion 182 on the gasket 180. Thus, correspondingly, the gasket 180 may be easily manufactured and assembled.

In addition, since the block support member 190 is configured as one O-ring, while the block support member 190 may be disposed separately from the gasket 180, the block support member 190 may be easily manufactured and assembled.

Although not illustrated in the drawing, the block support member may be also configured in an arc shape. In this case, the support member insertion groove 1727 may be disposed across both circumferential ends of the block support surfaces 1726*a* to 1726*d* like the above-described embodiment. However, it may be advantageous to dispose the support member insertion groove 1727 between both circumferential ends of the block support surfaces 1726*a* to 1726*d* to suppress separation of the block support member 190. Also, in this case, since the block support member 190 is not disposed between the axial fixing protrusions 1722 defining the discharge guide passage 170*a*, not only generation of a flow path barrier in the discharge guide passage 170*a* due to the block support member 190 may be prevented in advance, but also the block support member 190 may be prevented from coming into direct contact with refrigerant, thereby suppressing a damage to the block support member 190.

Although not shown in the drawing, a support member insertion groove (not shown) may be disposed in the rear surface 161*a* of the back pressure plate 161. In this case, the support member insertion groove may be configured in an annular shape.

Hereinafter, a description will be given of still another embodiment of the block support member.

That is, in the above-described embodiment, a block support member is configured in an annular elastic member. However, in some cases, a block support member may be disposed in one piece to be equipped between a back pressure chamber assembly and a retainer block.

Figure 19:
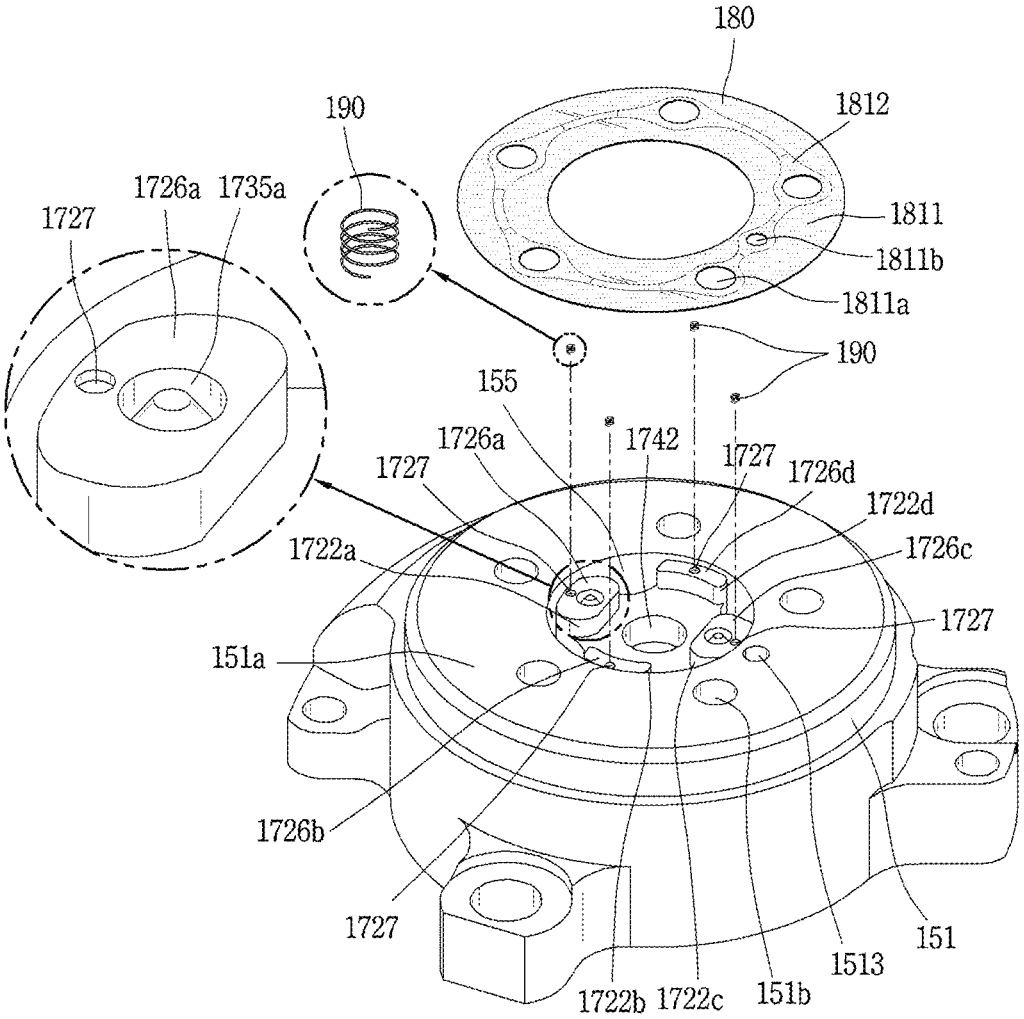
FIG. 19 is an assembled perspective view illustrating still another embodiment of the block support member of FIG. 13.
Figure 20:
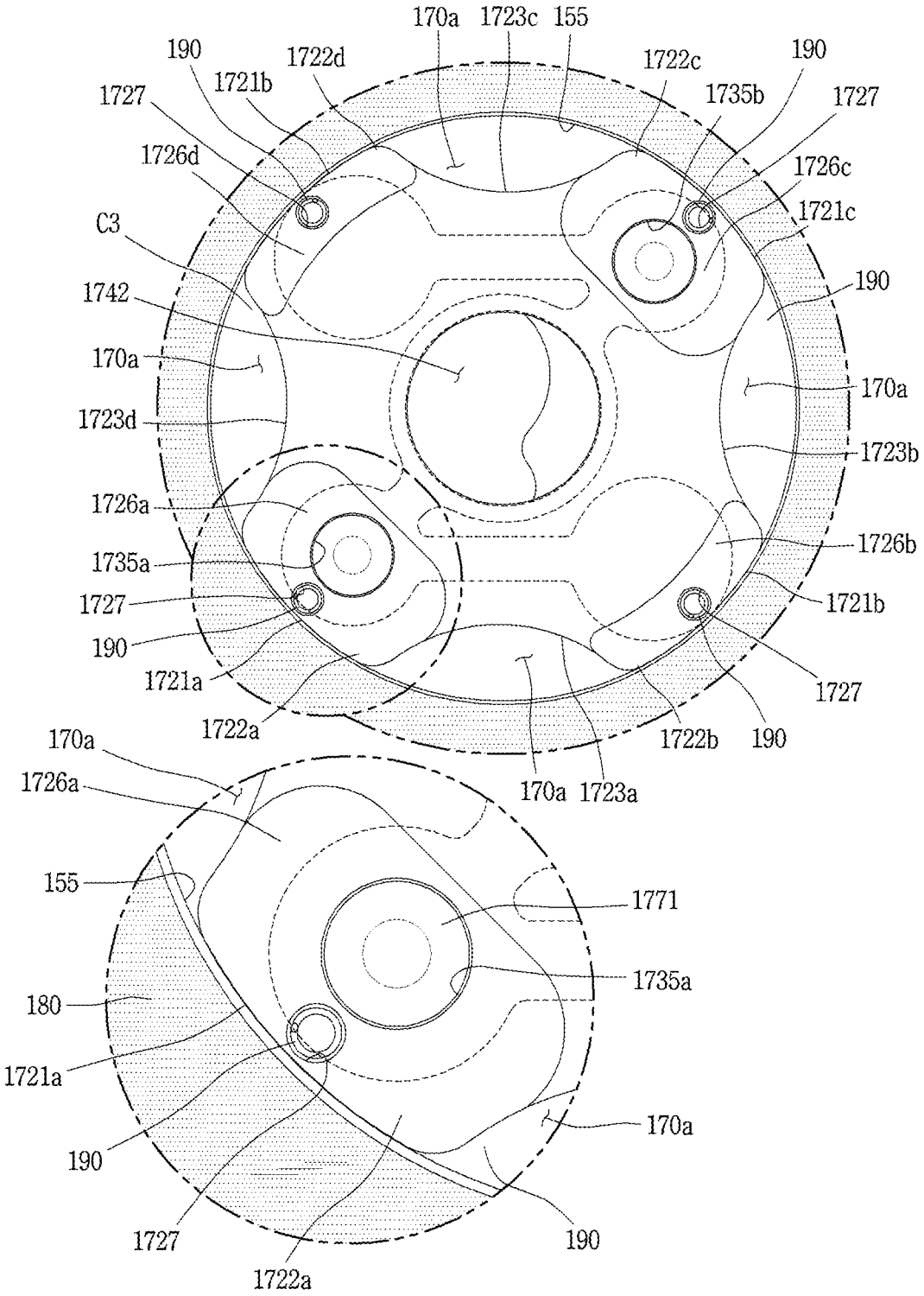
FIG. 20 is a planar view of FIG. 19.
Figure 21:
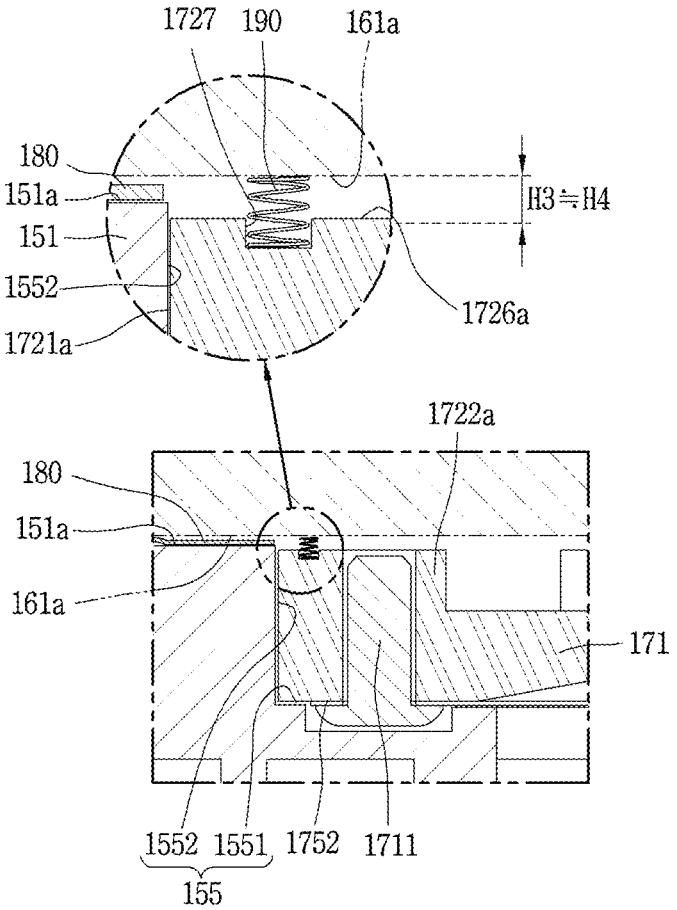
FIG. 21 is a sectional view taken along line "XV-XV" of FIG. 20.

Referring to FIGS. 19 to 21, the valve assembly 170 described above is disposed between the non-orbiting scroll 150 according to the embodiment and the back pressure chamber assembly 160. Since basic configurations and corresponding operational effects of the non-orbiting scroll 150, the back pressure chamber assembly 160, and the valve assembly 170 are similar to those in the above-described embodiments, and thus, will not be described here again.

However, whereas the block support member 190 is configured as an O-ring in the embodiment described with reference to FIG. 16, the block support member 190 may be configured as a spring in this embodiment.

For example, the block support member 190 according to this embodiment may be configured as a compression coil spring having axial elastic force and disposed between the rear surface 161*a* of the back pressure plate 161 and the block support surfaces 1726*a* to 1726*d* of the retainer block 171 facing the rear surface 161*a* in an axial direction. In this case, the support member insertion groove 1727 may be also disposed in the rear surface 161*a* of the back pressure plate 161 and/or the block support surfaces 1726*a* to 1726*d* of the retainer block 171 such that the block support member 190 is inserted and fixed into the support member insertion groove 1727. In this embodiment, an example in which the support member insertion groove 1727 is disposed in each of the block support surfaces 1726*a* to 1726*d* is shown.

Also, in this case, a height of the block support member 190, precisely, the protrusion height H3 of the block support member 190 protruding from the support member insertion groove 1727 may be configured to be equal to or greater than the gap H4 between the rear surface 161*a* of the back pressure plate 161 and the block support surfaces 1726*a* to 1726*d* of the retainer block 171, as shown in FIG. 21. Accordingly, in a process of fastening the back pressure chamber assembly 160 to the non-orbiting scroll 150 by the back pressure fastening bolt 177, the block support member 190 is pressed by fastening force of the back pressure fastening bolt 177 to thereby press the retainer block 171 toward the non-orbiting scroll 150 to provide support in an axial direction.

The support member insertion groove 1727 is disposed to be recessed in each of the block support surfaces 1726*a* to 1726*d* by a preset depth in an axial direction, wherein the preset depth is smaller than a height of the block support member 190. Accordingly, as described above, since at least a part of the block support member 190 protrudes from the support member insertion groove 1727 to cause the block support member 190 to be pressed by fastening force of the back pressure fastening bolt 177, the retainer block 171 may be pressed toward the non-orbiting scroll 150 to be supported in an axial direction.

In the embodiment, since the block support member 190 is separate from the gasket 180 to be disposed independently, there is no need to additionally configure a separate block support portion 182 on an inner circumferential surface of the gasket 180. Thus, correspondingly, the gasket 180 may be easily manufactured and assembled.

Although not shown in the drawing, the block support member 190 may be configured in a shape of a ball or a rectangular block other than a compression coil spring. Also, in this case, since the block support member 190 is not disposed between the axial fixing protrusions 1722 defining the discharge guide passage 170*a*, not only generation of a flow path barrier in the discharge guide passage 170*a* due to the block support member 190 may be prevented in advance, but also the block support member 190 may be prevented from coming into direct contact with refrigerant, thereby suppressing a damage to the block support member 190.

Although not shown in the drawing, the support member insertion groove 1727 may be disposed in the rear surface 161*a* of the back pressure plate 161. In this case, the support member insertion groove 1727 may be disposed to be recessed in an axial direction.

On the other hand, as described above, the embodiments of the valve assembly of the present disclosure may be equally applied to an open type as well as a hermetic type, to a high-pressure type as well as a low-pressure type, and even to a horizontal type as well as a vertical type. Those embodiments disclosed herein may also be equally applied to an orbiting back pressure type or a tip seal type as well as the non-orbiting back pressure type. In particular, in the orbiting back pressure type or the tip seal type, a separate plate, instead of the back pressure chamber assembly 160, may be fixed to the rear surface of the non-orbiting scroll 150 (fixed scroll), and the valve assembly of the previous embodiments may be fixed by using the plate. Even in this embodiment, the basic configuration of the valve assembly or the operational effect thereof may be substantially the same as those of the previous embodiments.

The invention claimed is:

1. A scroll compressor, comprising:

a casing having an inner space divided into a low-pressure portion and a high-pressure portion;

an orbiting scroll coupled to a rotational shaft in the inner space of the casing to perform an orbiting motion;

a non-orbiting scroll engaged with the orbiting scroll to define a compression chamber, and provided with a discharge port and a bypass hole through which refrigerant in the compression chamber is discharged; and a back pressure chamber assembly coupled to a rear surface of the non-orbiting scroll to press the non-orbiting scroll toward the orbiting scroll, wherein a block insertion groove is disposed in the rear surface of the non-orbiting scroll to be recessed by a preset depth to accommodate the discharge port and the bypass hole, wherein a retainer block comprising a bypass valve configured to open or close the bypass hole is inserted into the block insertion groove, wherein a block support member configured to support the retainer block toward the non-orbiting scroll is disposed between the retainer block and the back pressure chamber assembly facing the retainer block, wherein a gasket is disposed between the rear surface of the non-orbiting scroll and a rear surface of the back pressure chamber assembly facing the rear surface of the non-orbiting scroll, and wherein the gasket comprises:

a sealing portion disposed outside of the block insertion groove and between the non-orbiting scroll and the back pressure chamber assembly; and at least one block support portion that extends from an inner circumferential surface of the sealing portion to inside of the block insertion groove to be disposed between the retainer block and the back pressure chamber assembly.

2. The scroll compressor of claim 1, wherein the sealing portion is configured to have an inner diameter equal to or greater than an inner diameter of the block insertion groove.

3. The scroll compressor of claim 1, wherein the at least one block support portion comprises a plurality of block support portions, and wherein the plurality of block support portions is located on an inner circumferential surface of the sealing portion at a preset interval along a circumferential direction.

4. The scroll compressor of claim 3, wherein a plurality of axial fixing protrusions that extends in an axial direction is disposed on a surface of the retainer block facing the back pressure chamber assembly at a preset interval along the circumferential direction, and wherein the plurality of block support portions is disposed to axially correspond to the plurality of axial fixing protrusions on the retainer block.

5. The scroll compressor of claim 4, wherein the plurality of block support portions each comprises:

an extension protrusion that radially extends from the inner circumferential surface of the sealing portion; and a support protrusion that axially protrudes from the extension protrusion.

6. The scroll compressor of claim 5, wherein a block support surface facing the back pressure chamber assembly is disposed on the plurality of axial fixing protrusions on the retainer block, and the extension protrusion is configured to have a sectional area smaller than or equal to a sectional area of the block support surface.

7. The scroll compressor of claim 5, wherein a block support surface facing the back pressure chamber assembly is disposed on the plurality of axial fixing protrusions on the retainer block, and the support protrusion protrudes toward the block support surface.

8. The scroll compressor of claim 7, wherein the sealing portion comprises:

a sealing surface portion disposed between the rear surface of the non-orbiting scroll and the rear surface of the back pressure chamber assembly facing the rear surface of the non-orbiting scroll; and a sealing bead that axially protrudes from the sealing surface portion, and wherein the sealing bead protrudes in a direction opposite to the support protrusion.

9. A scroll compressor, comprising:

a casing having an inner space divided into a low-pressure portion and a high-pressure portion;

an orbiting scroll coupled to a rotational shaft in the inner space of the casing to perform an orbiting motion;

a non-orbiting scroll engaged with the orbiting scroll to define a compression chamber, and provided with a discharge port and a bypass hole through which refrigerant in the compression chamber is discharged; and a back pressure chamber assembly coupled to a rear surface of the non-orbiting scroll to press the non-orbiting scroll toward the orbiting scroll, wherein a block insertion groove is disposed in the rear surface of the non-orbiting scroll to be recessed by a preset depth to accommodate the discharge port and the bypass hole, wherein a retainer block comprising a bypass valve configured to open or close the bypass hole is inserted into the block insertion groove, wherein a block support member configured to support the retainer block toward the non-orbiting scroll is disposed between the retainer block and the back pressure chamber assembly facing the retainer block, and wherein the block support member is disposed to be separate from a gasket located outside of the block insertion groove and configured to perform sealing between the rear surface of the non-orbiting scroll and a rear surface of the back pressure chamber assembly facing the rear surface of the non-orbiting scroll.

10. The scroll compressor of claim 9, wherein the block support member is made of a material having elasticity to elastically support the retainer block with respect to the back pressure chamber assembly.

11. The scroll compressor of claim 10, wherein a support member insertion groove is disposed in the rear surface of the back pressure chamber assembly or one side surface of the retainer block facing the rear surface of the back pressure chamber assembly, and the block support member is inserted and fixed into the support member insertion groove.

12. The scroll compressor of claim 11, wherein a plurality of axial fixing protrusions that extends in an axial direction is disposed on a surface of the retainer block facing the back pressure chamber assembly at a preset interval along a circumferential direction, and wherein the block support member is configured to have an annular shape to terminate the plurality of axial fixing protrusions in the circumferential direction.

13. The scroll compressor of claim 11, wherein a plurality of axial fixing protrusions that extends in an axial direction is disposed on a surface of the retainer block facing the back pressure chamber assembly at a preset interval along a circumferential direction, and wherein the block support member is configured in an individual piece and disposed individually in each of the plurality of axial fixing protrusions.

14. The scroll compressor of claim 1, wherein an inner circumferential surface of the block insertion groove is configured to have a circular shape when projected in an axial direction.

15. The scroll compressor of claim 1, wherein the retainer block is fixedly in close contact with the rear surface of the non-orbiting scroll and a rear surface of the back pressure chamber assembly axially facing the rear surface of the non-orbiting scroll by a fastening force for fastening the non-orbiting scroll with the back pressure chamber assembly.

16. The scroll compressor of claim 9, wherein an inner circumferential surface of the block insertion groove is configured to have a circular shape when projected in an axial direction.

17. The scroll compressor of claim 9, wherein the retainer block is fixedly in close contact with the rear surface of the non-orbiting scroll and a rear surface of the back pressure chamber assembly axially facing the rear surface of the non-orbiting scroll by a fastening force for fastening the non-orbiting scroll with the back pressure chamber assembly.

* * * * *